US006408945B1

(12) United States Patent
Telfer

(10) Patent No.: US 6,408,945 B1
(45) Date of Patent: Jun. 25, 2002

(54) TOOL AND METHOD FOR REMOVING EXCESS CEMENT FROM THE TOP OF A LINER AFTER HANGING AND CEMENTING THEREOF

(75) Inventor: Geroge Telfer, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/355,703

(22) PCT Filed: Jan. 16, 1998

(86) PCT No.: PCT/GB98/00149

§ 371 (c)(1),
(2), (4) Date: Oct. 28, 1999

(87) PCT Pub. No.: WO98/35131

PCT Pub. Date: Aug. 13, 1998

(51) Int. Cl.[7] ..... E21B 34/00
(52) U.S. Cl. ..... 166/311; 166/177.4
(58) Field of Search ..... 166/311, 382, 166/208, 212, 177.4, 374, 386

(56) References Cited

U.S. PATENT DOCUMENTS

| | | | | |
|---|---|---|---|---|
| 2,117,836 | A | 5/1938 | Brown | |
| 2,177,721 | A | 10/1939 | Johnson et al. | |
| 2,220,237 | A | 11/1940 | Hall | |
| 2,237,863 | A | 4/1941 | Donaldson | |
| 2,303,556 | A | 12/1942 | Johnson et al. | |
| 2,373,880 | A | 4/1945 | Driscoll | |
| 2,713,913 | A | 7/1955 | Ragan | |
| 2,772,740 | A | 12/1956 | Edwards | |
| 2,876,844 | A | 3/1959 | Warner | 166/126 |
| 2,913,052 | A | 11/1959 | Harmon | |
| 3,291,220 | A | 12/1966 | Mott | 166/212 X |

(List continued on next page.)

FOREIGN PATENT DOCUMENTS

| | | | |
|---|---|---|---|
| GB | 1597441 | 9/1981 | E21B/43/10 |
| GB | 2165282 B | 4/1986 | E21B/43/10 |
| GB | 2231359 A | 11/1990 | E21B/21/00 |
| GB | 2242461 A | 10/1991 | E21B/21/10 |
| GB | 2272923 B | 6/1994 | E21B/21/10 |
| GB | 2284436 A | 6/1995 | E21B/43/10 |

OTHER PUBLICATIONS

Products & Services Catalog, Weatherford, 1994.
1994–95 General Catalog, TIW, 1994.
1982 Catalog, Brown Oil Tools, pp. 115–129 (section on liner hangers and assoc. equipment).

*Primary Examiner*—Frank Tsay
(74) *Attorney, Agent, or Firm*—Moser, Patterson & Sheridan, L.L.P.

(57) ABSTRACT

A tool (100) for removing excess cement from the top of a liner (51) after hanging and cementing thereof by inner string comprises a hollow mandrel (4), a valve sleeve (7) and a port (12) in said hollow mandrel (4) wherein said valve sleeve (7) is movable to open and close said port (122) to allow circulating fluid to be introduced into the liner (51) or casing in the vicinity of the liner hanger (54) supporting the liner. The circulating fluid washes the excess cement away and a non rotating casing scraper can obviate the need for a separate trip to clean the inside of the casing. An apparatus is also disclosed for indicating that a predetermined quantity of fluid has been ejected from a pipe in a wellbore comprising a pressure gauge, a dart (280), a shearable member (293) initially shearably attached to said dart (280) and a landing seat wherein, in use, said dart (280) follows said predetermined quantity of fluid through said pipe, said shearable member (293) lands on said landing seat (294), a pressure increase is noted on said pressure gauge, said dart (280) shearing away from said shearable member (293), indicating that a fixed quantity of fluid is now left in said pipe to be ejected. A liner is also disclosed which comprises at least one of a float collar and a float shoe mounted therein, characterized in that said liner is further provided with a closure member (291) which, in use, on withdrawal of a stinger (259), closes.

11 Claims, 34 Drawing Sheets

U.S. PATENT DOCUMENTS

| | | | | | |
|---|---|---|---|---|---|
| 3,581,817 | A | | 6/1971 | Kammerer, Jr. | 166/208 |
| 3,608,634 | A | | 9/1971 | Cochran | 166/208 |
| 3,720,261 | A | | 3/1973 | Heilhecker et al. | 166/208 |
| 3,797,572 | A | * | 3/1974 | Mignotte | 166/127 |
| 3,993,128 | A | | 11/1976 | Braddick | 166/216 |
| 3,999,605 | A | | 12/1976 | Braddick | 166/212 |
| 4,010,804 | A | | 3/1977 | Garcia | 166/315 |
| 4,030,546 | A | | 6/1977 | Rogers et al. | 166/208 |
| 4,033,640 | A | | 7/1977 | Garcia | 308/4 A |
| 4,047,565 | A | | 9/1977 | Crickmer | 166/217 |
| 4,058,166 | A | | 11/1977 | Crickmer | 166/316 |
| 4,060,131 | A | | 11/1977 | Kenneday et al. | 166/315 |
| 4,067,358 | A | | 1/1978 | Streich | 137/624.13 |
| 4,096,913 | A | | 6/1978 | Kennedy et al. | 166/290 |
| 4,249,601 | A | | 2/1981 | White | 166/208 |
| 4,281,711 | A | | 8/1981 | Braddick et al. | 166/118 |
| 4,291,764 | A | | 9/1981 | Pampell | 166/173 |
| 4,311,194 | A | | 1/1982 | White | 166/120 |
| 4,440,218 | A | * | 4/1984 | Farley | 166/51 |
| 4,562,889 | A | | 1/1986 | Braddick | 166/381 |
| 4,603,743 | A | | 8/1986 | Lindsey, Jr. | 166/382 |
| 4,674,576 | A | | 6/1987 | Goris et al. | 166/382 |
| 4,687,063 | A | | 8/1987 | Gilbert | 166/382 |
| 4,688,642 | A | | 8/1987 | Baker | 166/382 |
| 4,825,954 | A | | 5/1989 | Baugh | 166/382 |
| 4,834,185 | A | | 5/1989 | Braddick | 155/382 |
| 4,848,469 | A | | 7/1989 | Baugh et al. | 166/382 |
| 4,854,386 | A | | 8/1989 | Baker et al. | 166/289 |
| 4,911,237 | A | | 3/1990 | Melenzer | 166/208 |
| 4,926,938 | A | | 5/1990 | Lindsey, Jr. | 166/208 |
| 5,018,579 | A | | 5/1991 | Braddick et al. | 166/382 |
| 5,018,582 | A | | 5/1991 | Baker | 166/382 |
| 5,038,860 | A | | 8/1991 | Baugh et al. | 166/208 |
| 5,048,606 | A | | 9/1991 | Allwin | 166/208 |
| 5,048,611 | A | * | 9/1991 | Cochran | 166/374 |
| 5,074,362 | A | | 12/1991 | Allwin | 166/382 |
| 5,086,845 | A | | 2/1992 | Baugh | 166/352 |
| 5,327,964 | A | | 7/1994 | O'Donnell et al. | 166/208 |
| 5,404,955 | A | | 4/1995 | Echols, III et al. | 166/382 |
| 5,417,288 | A | | 5/1995 | Melenzer et al. | 166/382 |
| 5,443,124 | A | * | 8/1995 | Wood et al. | 166/374 |
| 5,472,055 | A | | 12/1995 | Simson et al. | 166/382 |
| 5,794,694 | A | | 8/1998 | Smith, Jr. | 166/212 |

* cited by examiner 100
1
3
4
5
6
7
10
9
11
13
12
13
14
14
16
8
17
19
18
18
20
21
22
23
15
24

53
57
77
55
1500
76
56
54

300
218
221
207
2000
2500
150
181
176
153

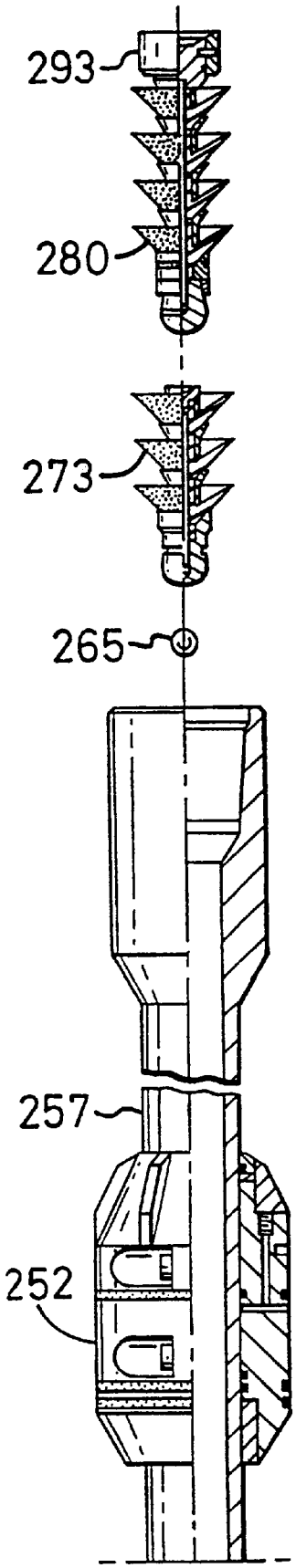
FIG. 8A
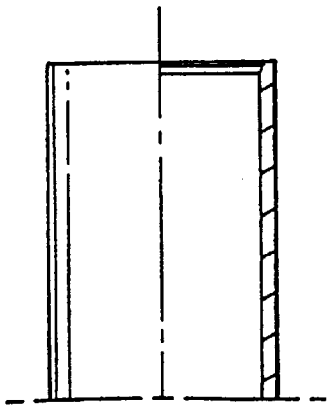

3500
253
276
3000
257
255
256

TOOL AND METHOD FOR REMOVING EXCESS CEMENT FROM THE TOP OF A LINER AFTER HANGING AND CEMENTING THEREOF

This invention relates to a tool and method for removing excess cement from the top of a liner after hanging and cementing thereof, a running tool including said tool, a liner-hanger system including said running tool; a casing scraper, a method of cleaning a casing using said casing scraper; an apparatus for indicating that a predetermined quantity of fluid has been ejected from a pipe in a wellbore; a liner; and a second liner hanger system.

During the construction of oil and gas wells, a wellbore is drilled in the ground a certain distance. A string of tubulars is then lowered down the wellbore and cemented in place. The wellbore is then drilled a further distance. A liner is then lowered down the wellbore and hung and cemented in place. During cementing, wet cement Is introduced through the-bottom of the liner and travels upwardly in the annular space between the liner and the wellbore. One problem which arises in the disposal of the excess cement which accumulates at the top of the liner.

Heretofore, one method of removing this cement has been by the use of a special casing scraper. Scraping of the casing with a conventional casing scraper requires a separate trip and is thus time consuming and expensive.

According to a first aspect of the invention there is provided in or for use in a running tool, a tool for removing excess cement from the top of a liner after hanging and cementing thereof.

Other features of the first aspect of the invention are set out in claims 2 to 14.

There is also provided a running tool fitted with the tool as defined above and a liner hanging system comprising a liner hanger assembly and a running tool in accordance with the present invention.

There is also provided a method for facilitating the removal of excess cement from a liner after hanging and cementing thereof, comprising the step of circulating a fluid through a stinger of a running tool and a liner.

There is further provided a method for facilitating the removal of excess cement from the top of a liner after hanging and cementing thereof, comprising the step of introducing circulating fluid in the vicinity of the top of said liner. The method is preferably carried out when the cement is wet and when the introduction of circulating fluid occurs immediately after cementing has finished and/or as soon as a packer is set in the annulus between the liner and the casing.

According to a second aspect of the invention there is provided a casing scraper comprising at least one scraper pad arranged on a tubular member, characterised in that said at least one scraper pad is rotatable about said tubular member.

Other features of the second aspect of the invention are set forth in claims 22–27.

There is also provided a method of cleaning a casing using the casing scraper in accordance with the invention comprising the steps of hanging and cementing a liner, disconnecting the running tool from the liner and raising the tool string in order to clean debris from said casing.

After the liner has been hung, the cementing procedure begins. A predetermined quantity of cement is pumped down the drill string through the tool string, through the stinger out through the bottom of the liner and up into the annulus formed by the liner and the wellbore. The cement is followed by a dart which amongst other things, cleans the interior surfaces of the drill pipe.

A problem for the well operator is that it is difficult to predict when all of the cement has left the stinger and is in the annulus between the liner and the wellbore.

Prior to this aspect of the invention, the well operator simply used a gauge which indicates the quantity of cement entering the drill pipe. This gauge can be relatively inaccurate. For example, when pumping 2000 barrels an inaccuracy of 50 barrels would not be uncommon.

When the gauge indicates that nearly all of the cement has passed the bottom of the stinger, the well operator would expect a slight pressure increase due to the dart following the cement landing in a shearable landing collar. This would be followed by a pressure drop when the shear pins joining the shearable landing collar to the stinger shear. If the dart for any reason did not land or passed through the shearable landing collar, the well operator may not realise that all of the cement in the well has passed through the end of the stinger. This could cause mud or water to be pumped into the annulus between the liner and the wellbore.

Accordingly there is provided an apparatus for indicating that a predetermined quantity of fluid has been ejected from a pipe in a wellbore, which apparatus comprises a pressure gauge, a dart comprising a body and a member shearably attached thereto, and a landing seat, the arrangement being such that, in use, said dart follows said predetermined quantity of fluid through said pipe and lands on said landing seat, a pressure increase is noted on said pressure gauge until said body of said dart shears away from said member, said pressure increase indicating that said dart has reached a known position in said wellbore.

The present invention also provides a liner having at least one of a float collar and a float shoe mounted therein, characterised in that said liner is further provided with a closure member which, in use, on withdrawal of a stinger closes, thereby allowing circulation to be carried out through the end of the stinger after withdrawal thereof, without disturbing the wet cement at the bottom of the liner and in the annulus between the liner and the wellbore.

Other features of this aspect of the invention are set out in claims 33 and 34.

For a better understanding of the present invention reference will now be made, by way of example, to the accompanying drawings, in which.

Figure 4:
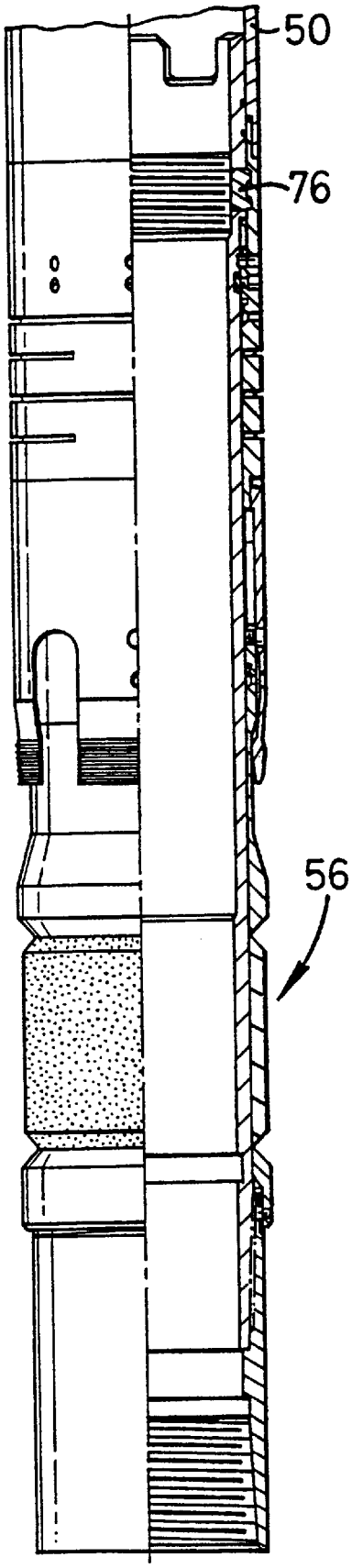
Figure 6:
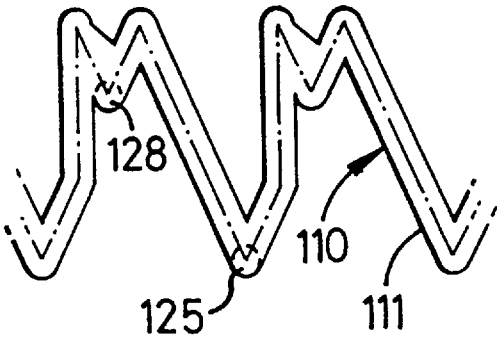
Figure 3A:
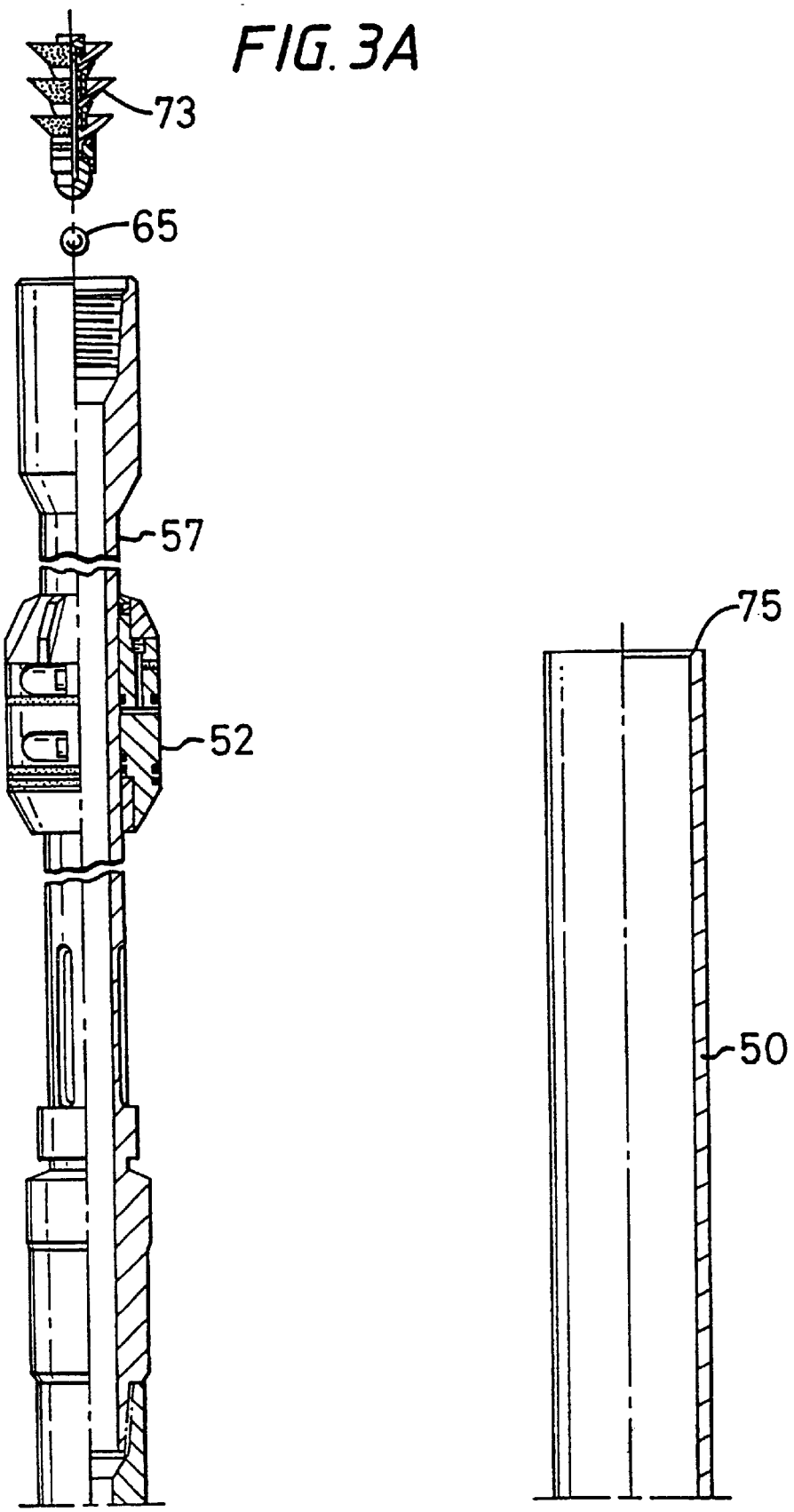
Figure 3B:
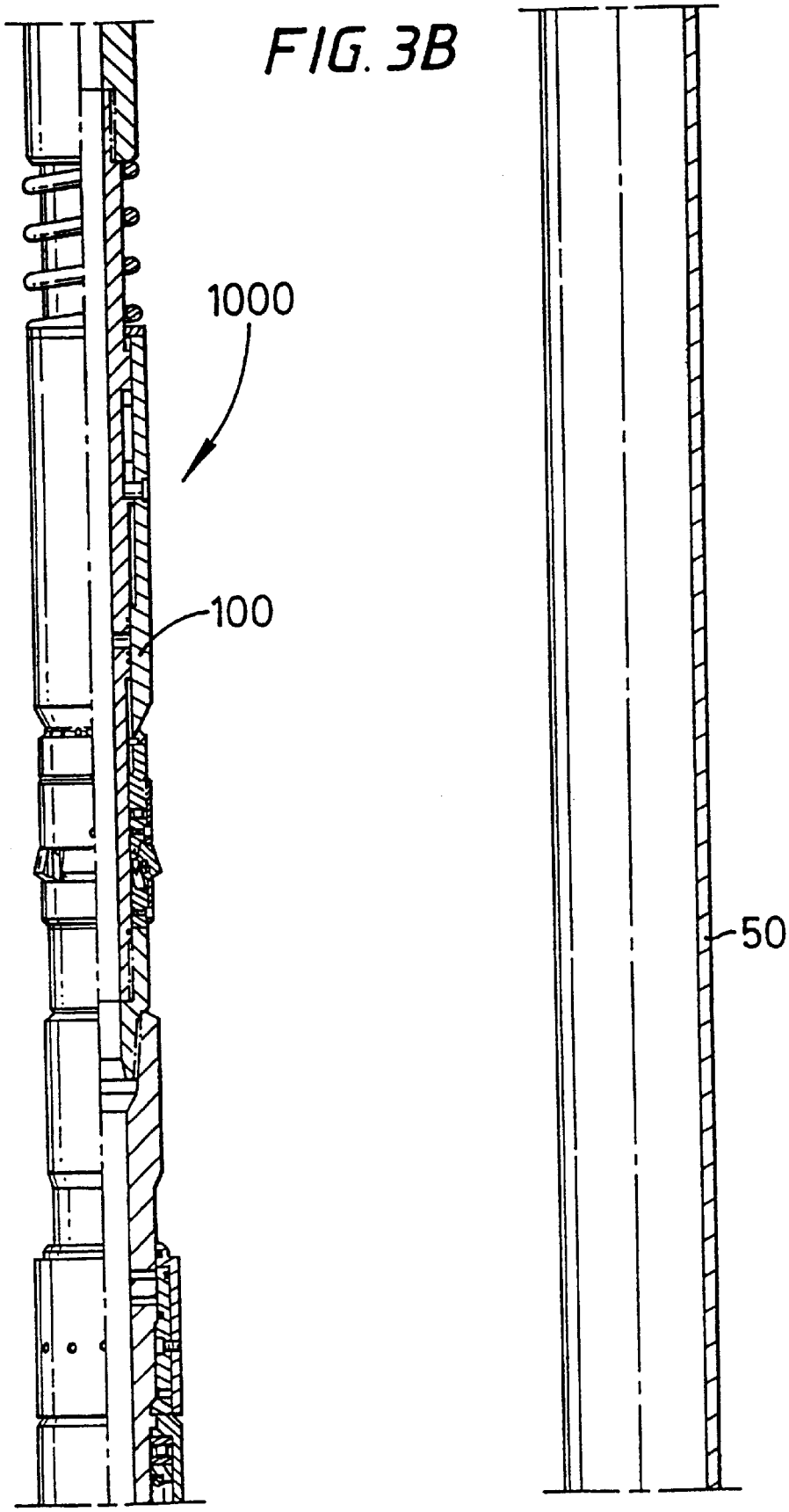
Figure 3C:
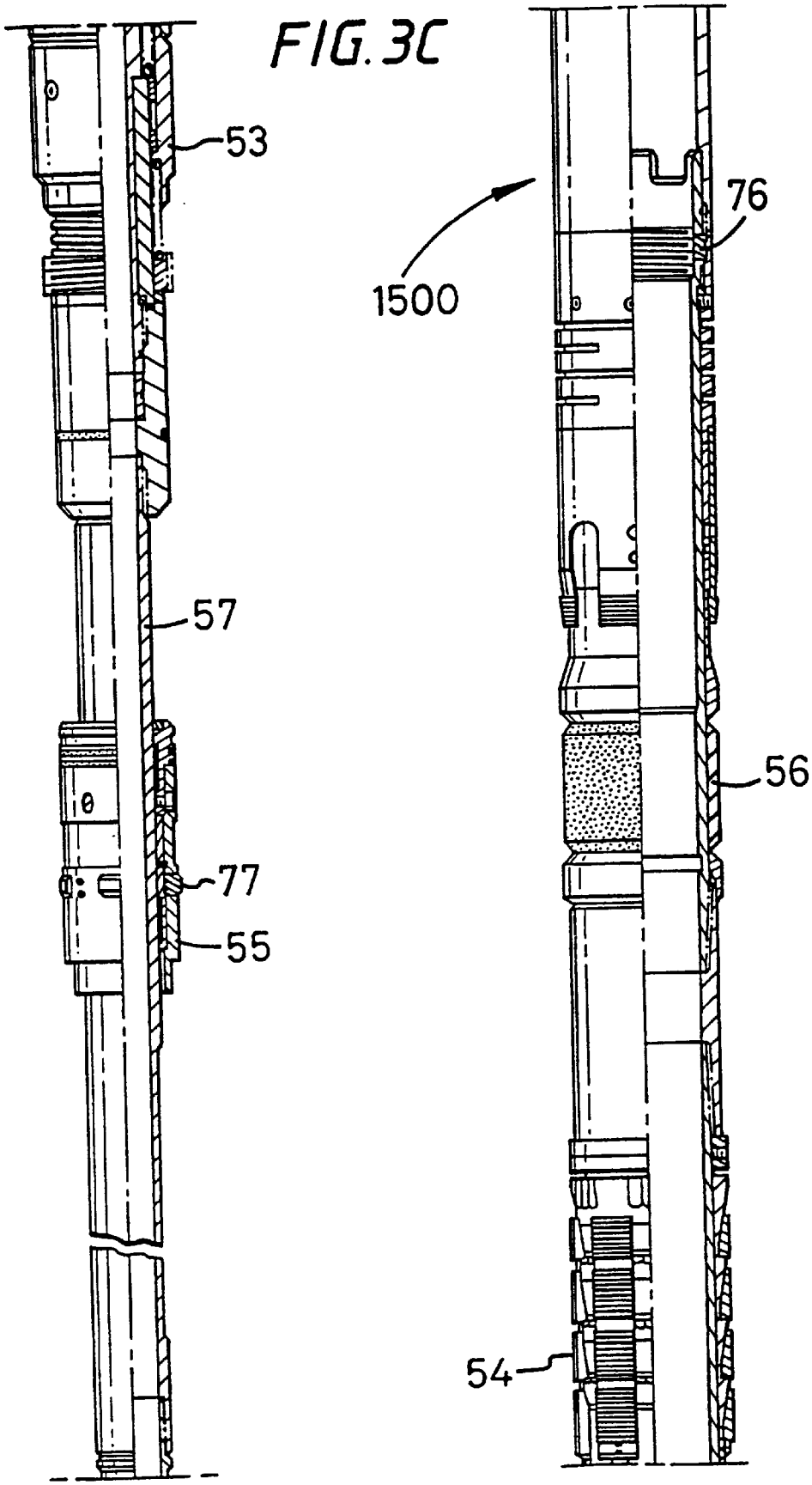
Figure 3D:
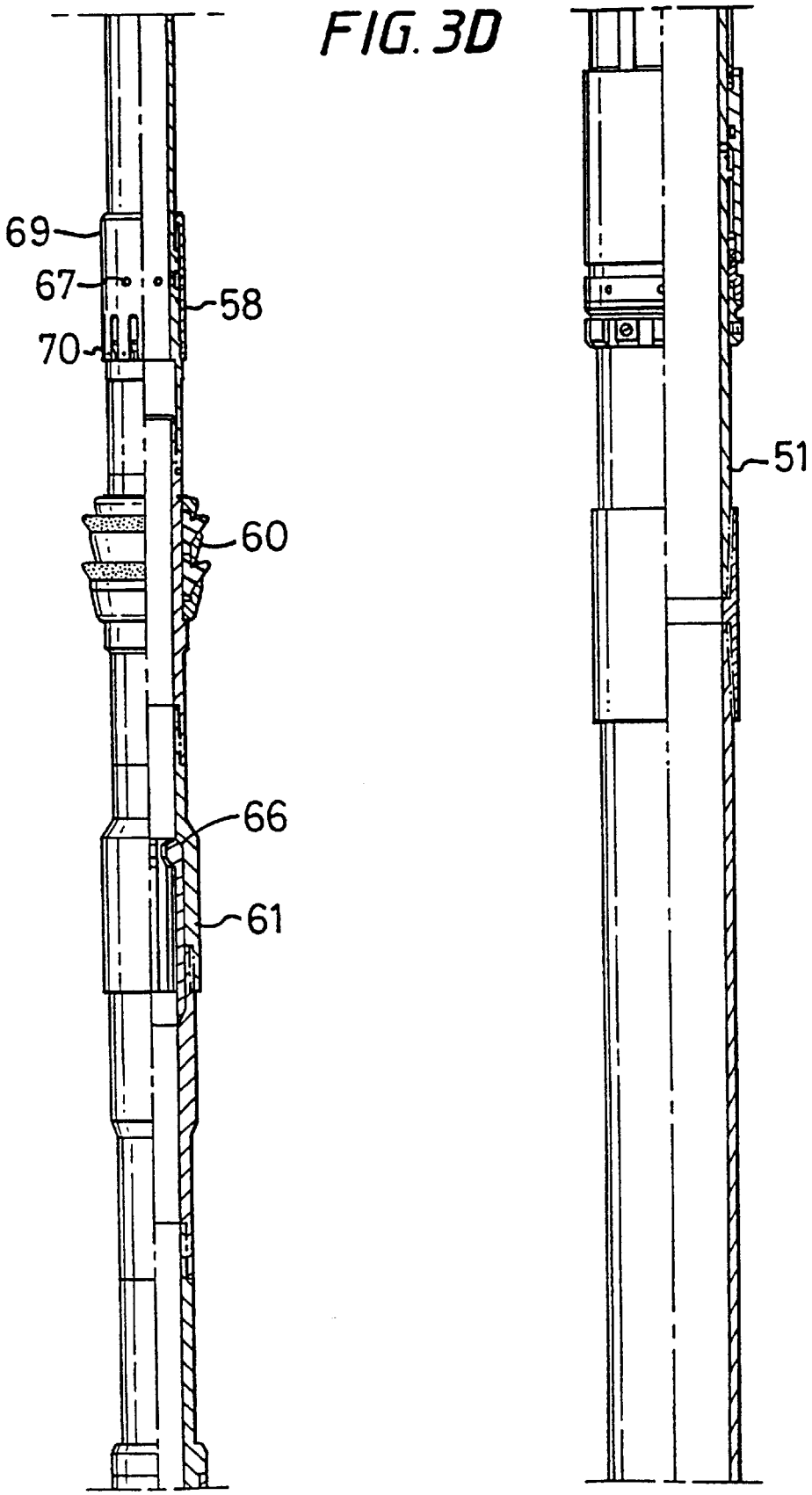
Figure 3E:
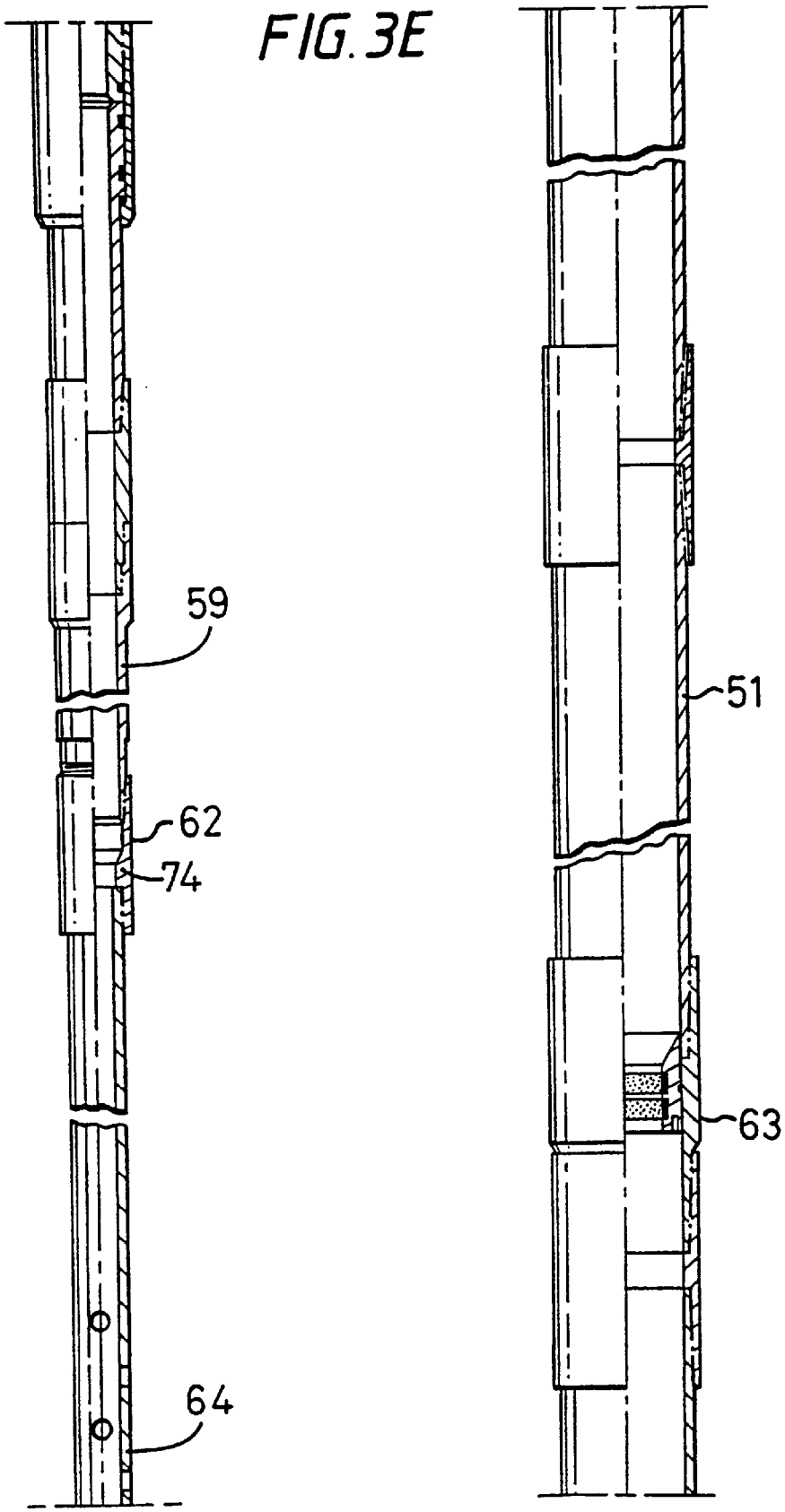
Figure 3F:
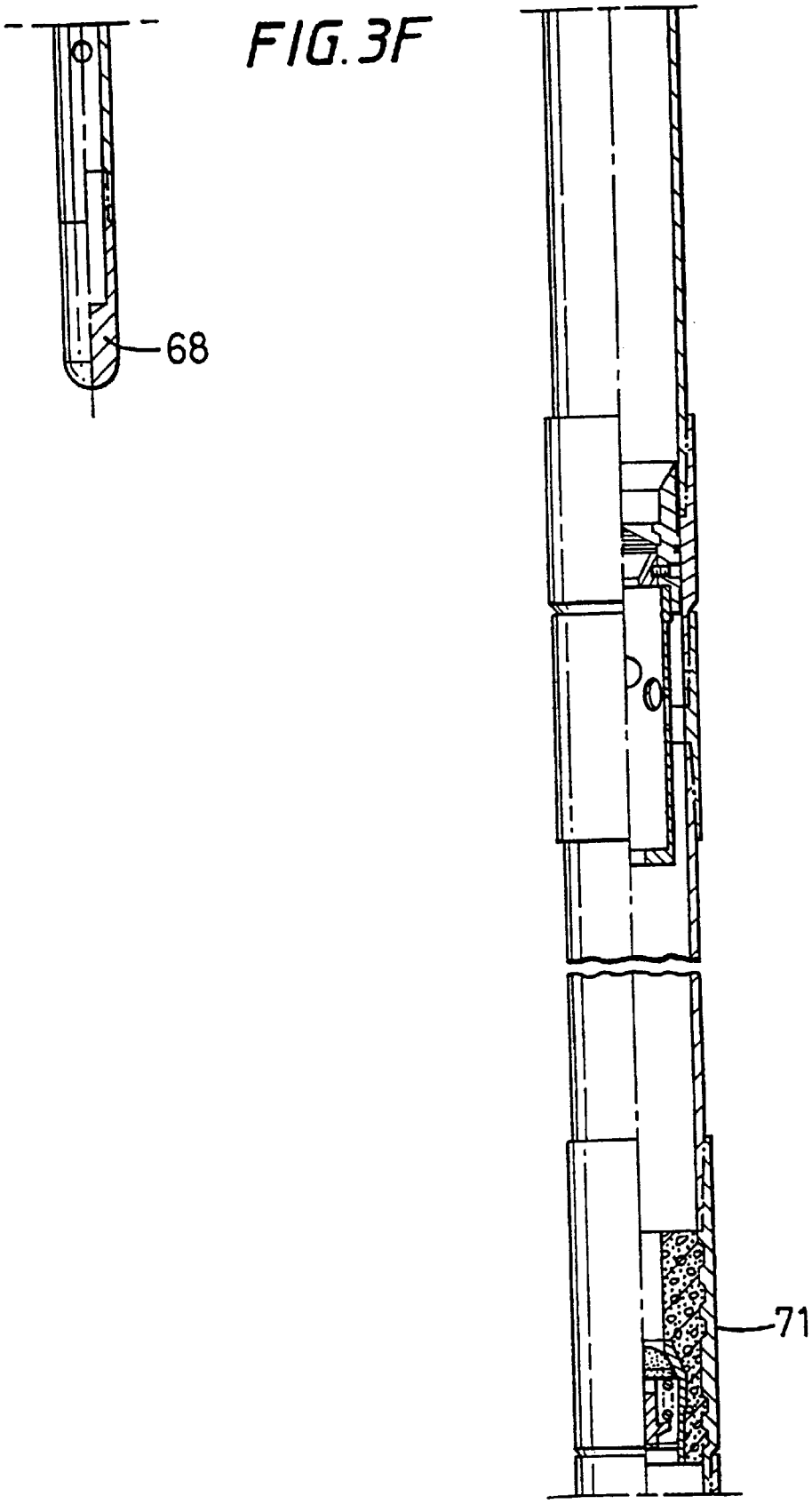
Figure 3G:
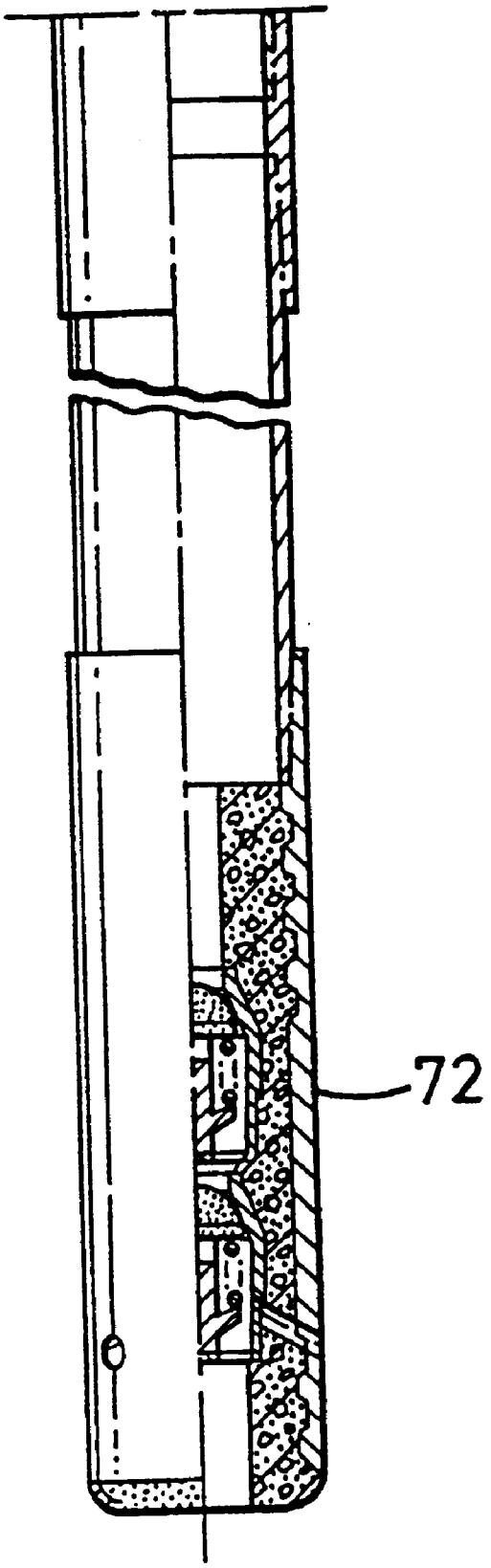
Figure 5:
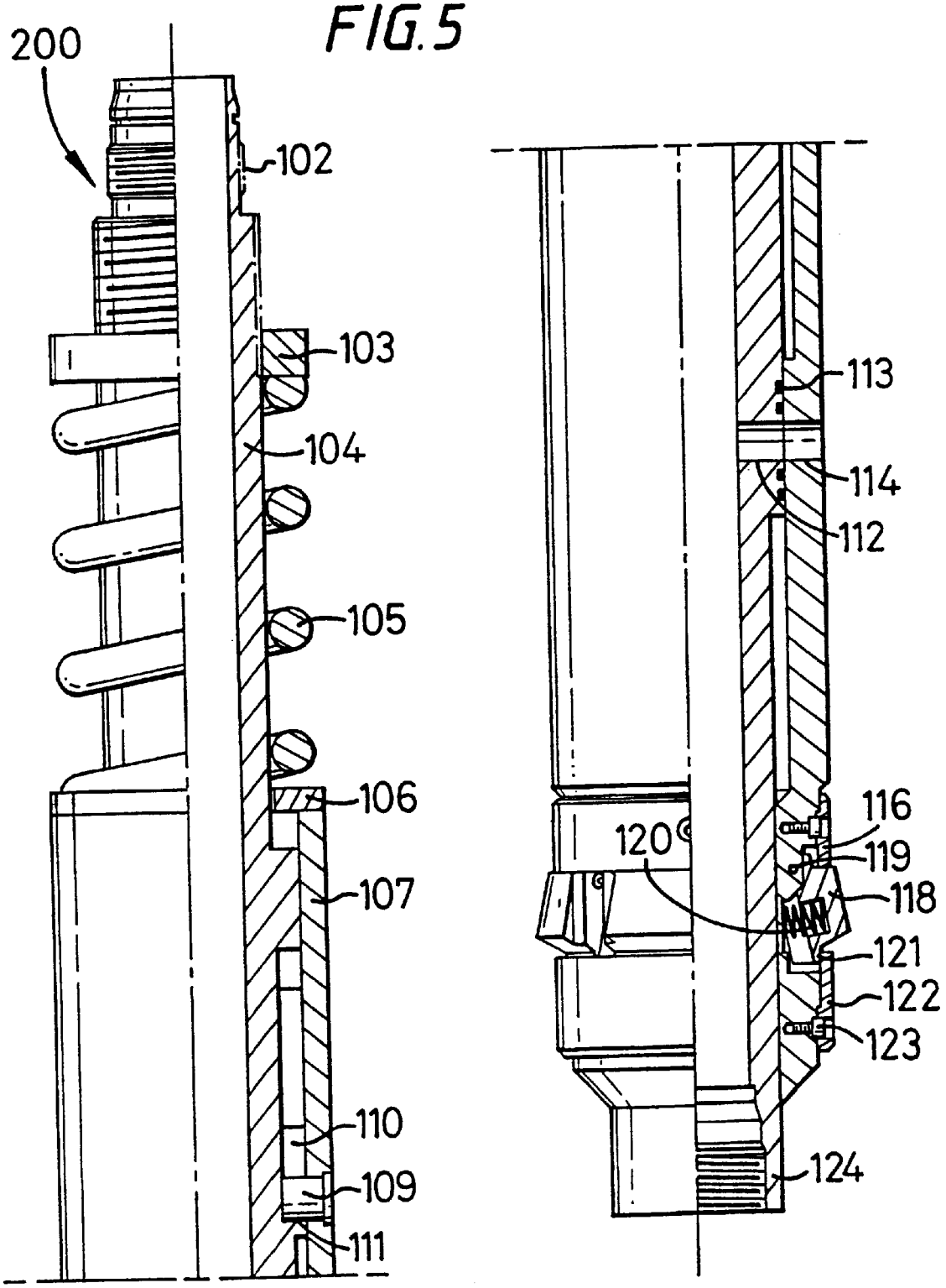
Figure 7A:
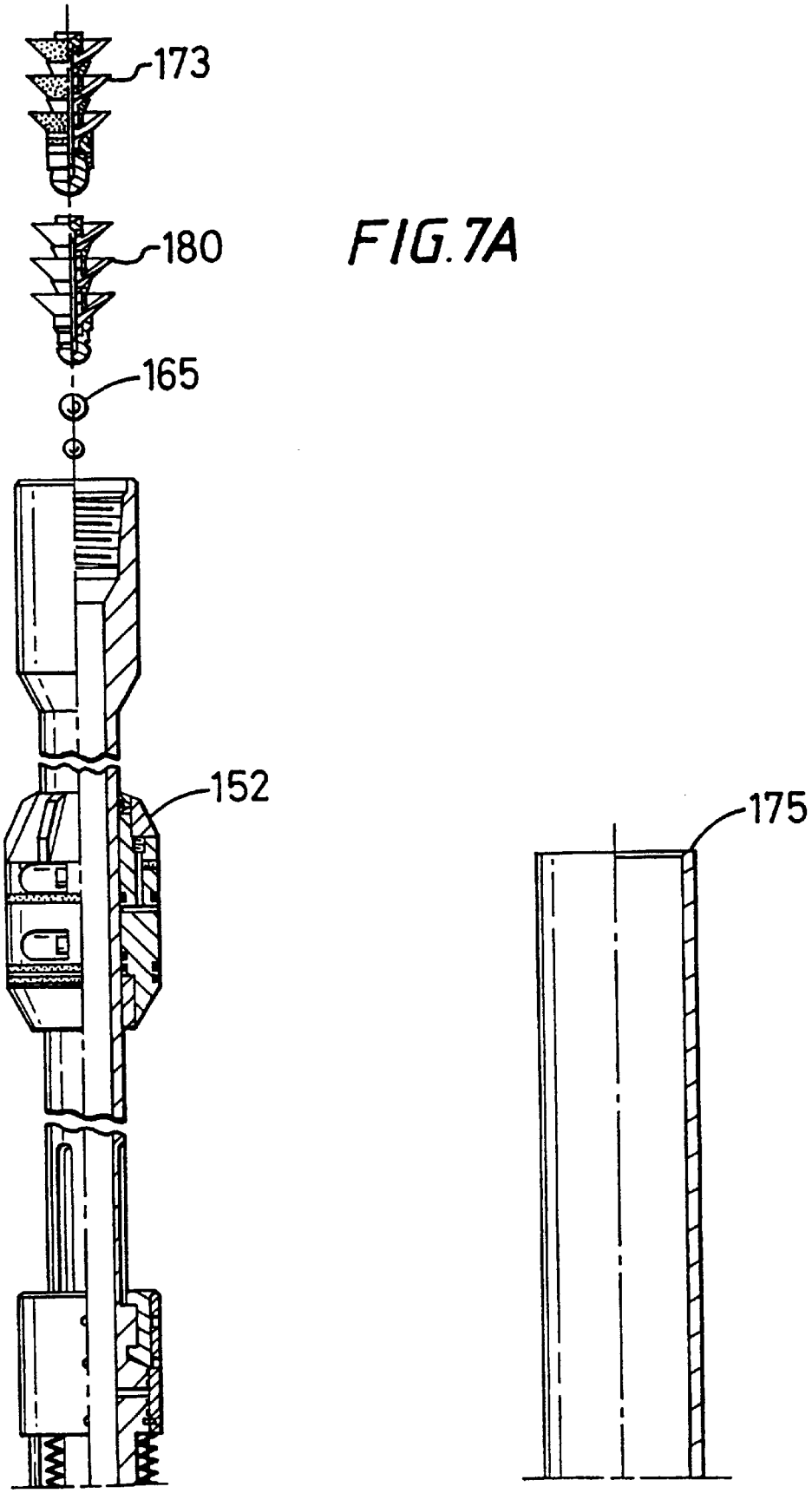
Figure 7B:
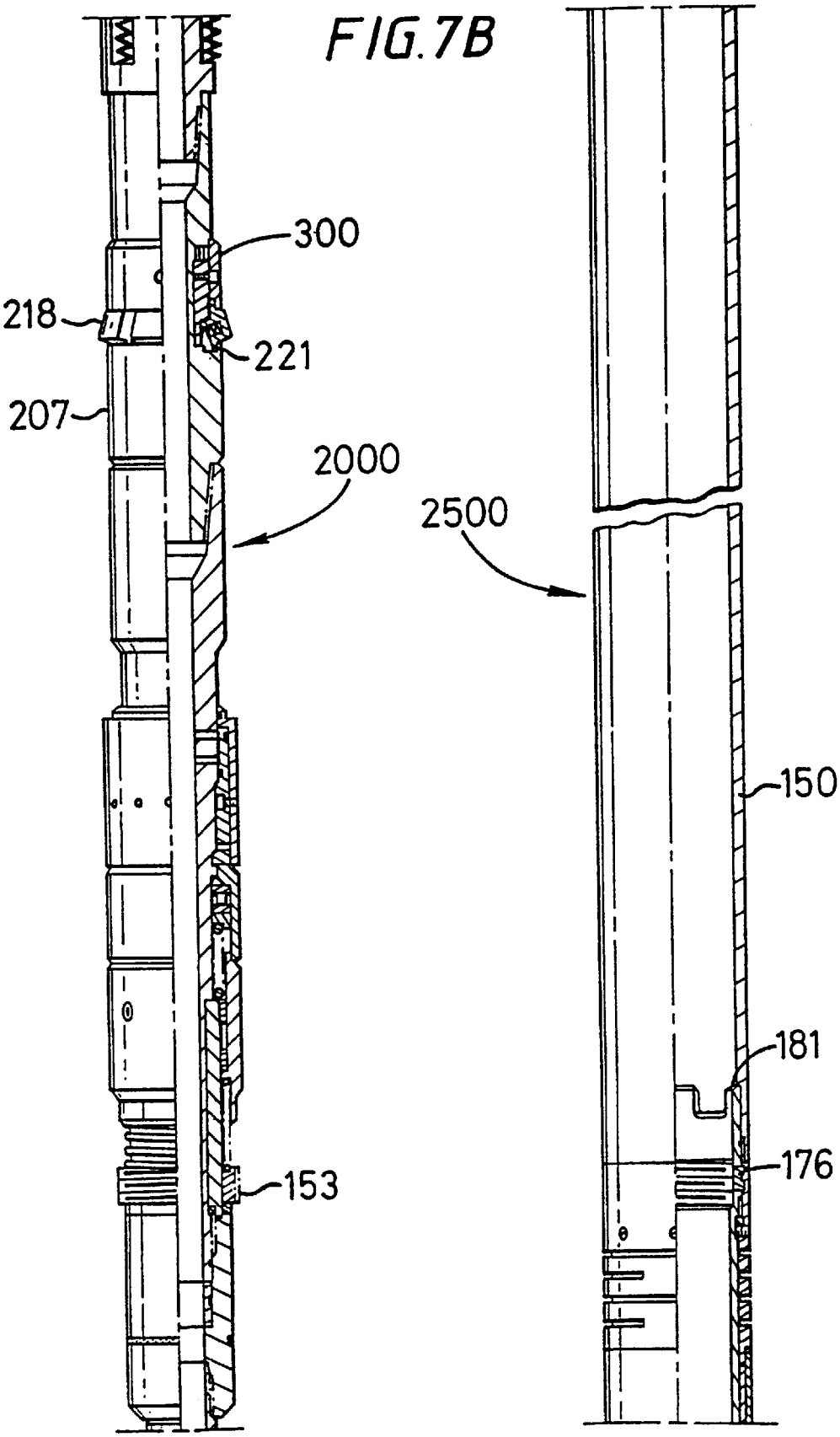
Figure 7C:
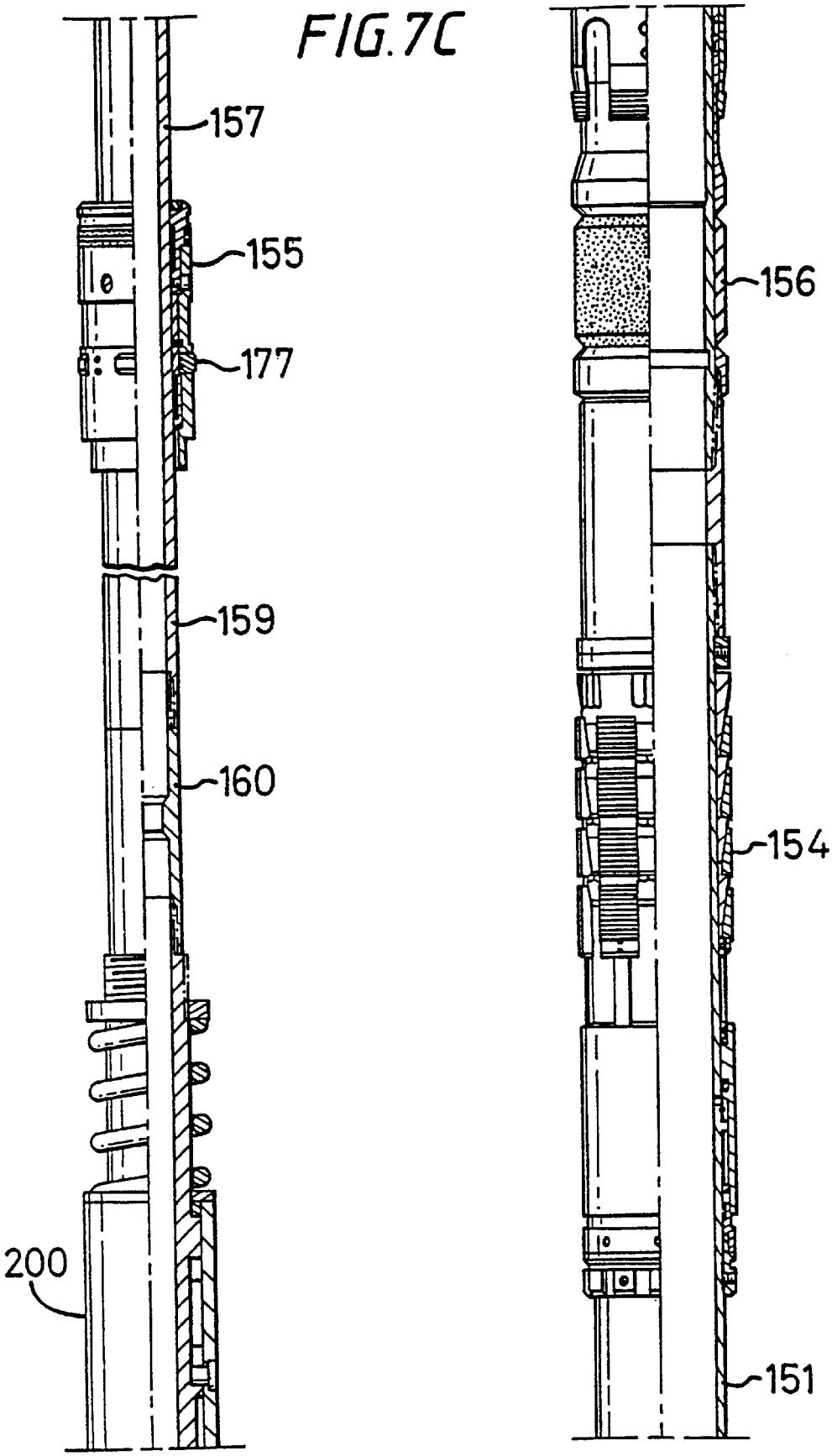
Figure 7D:
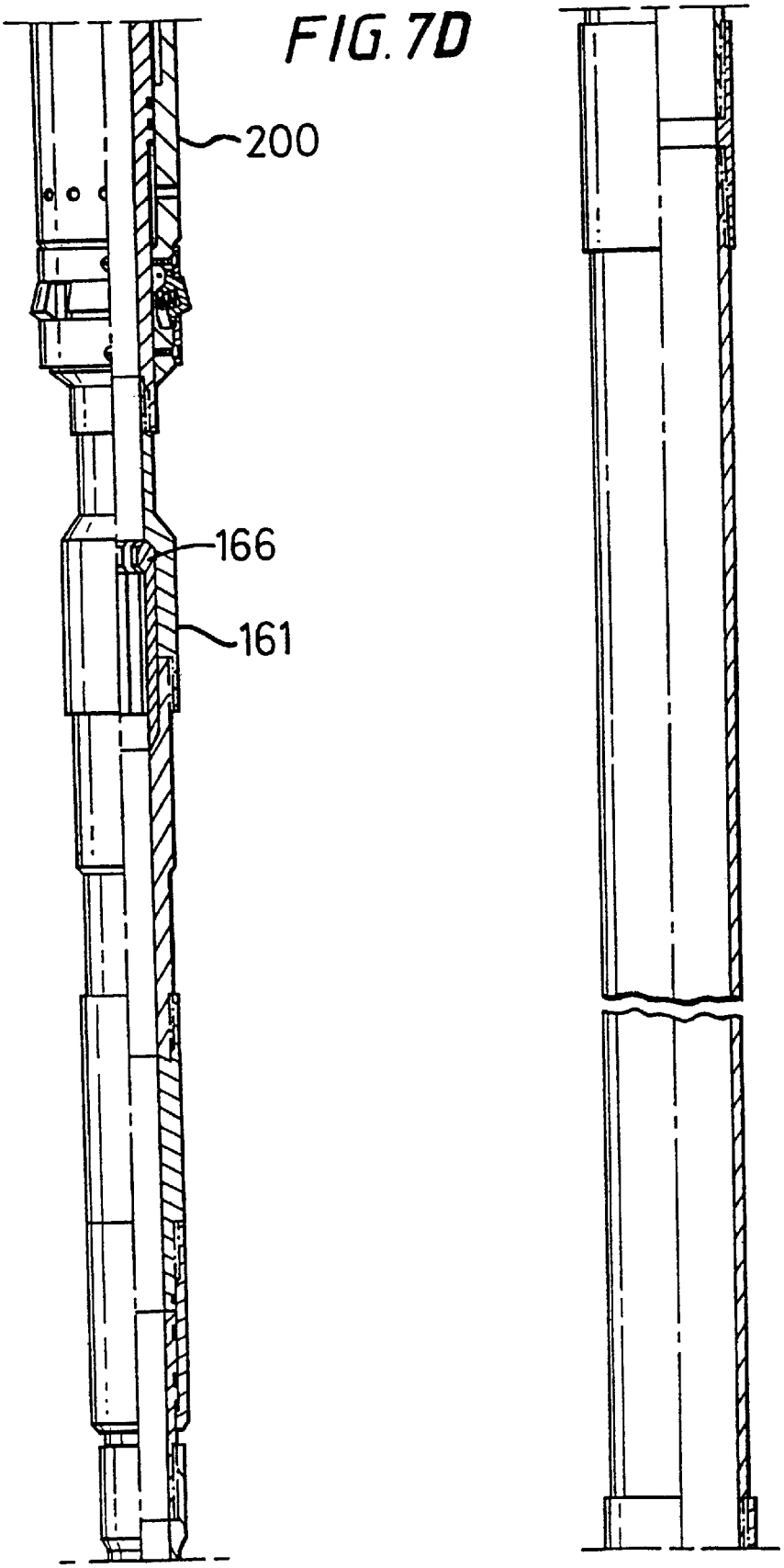
Figure 7E:
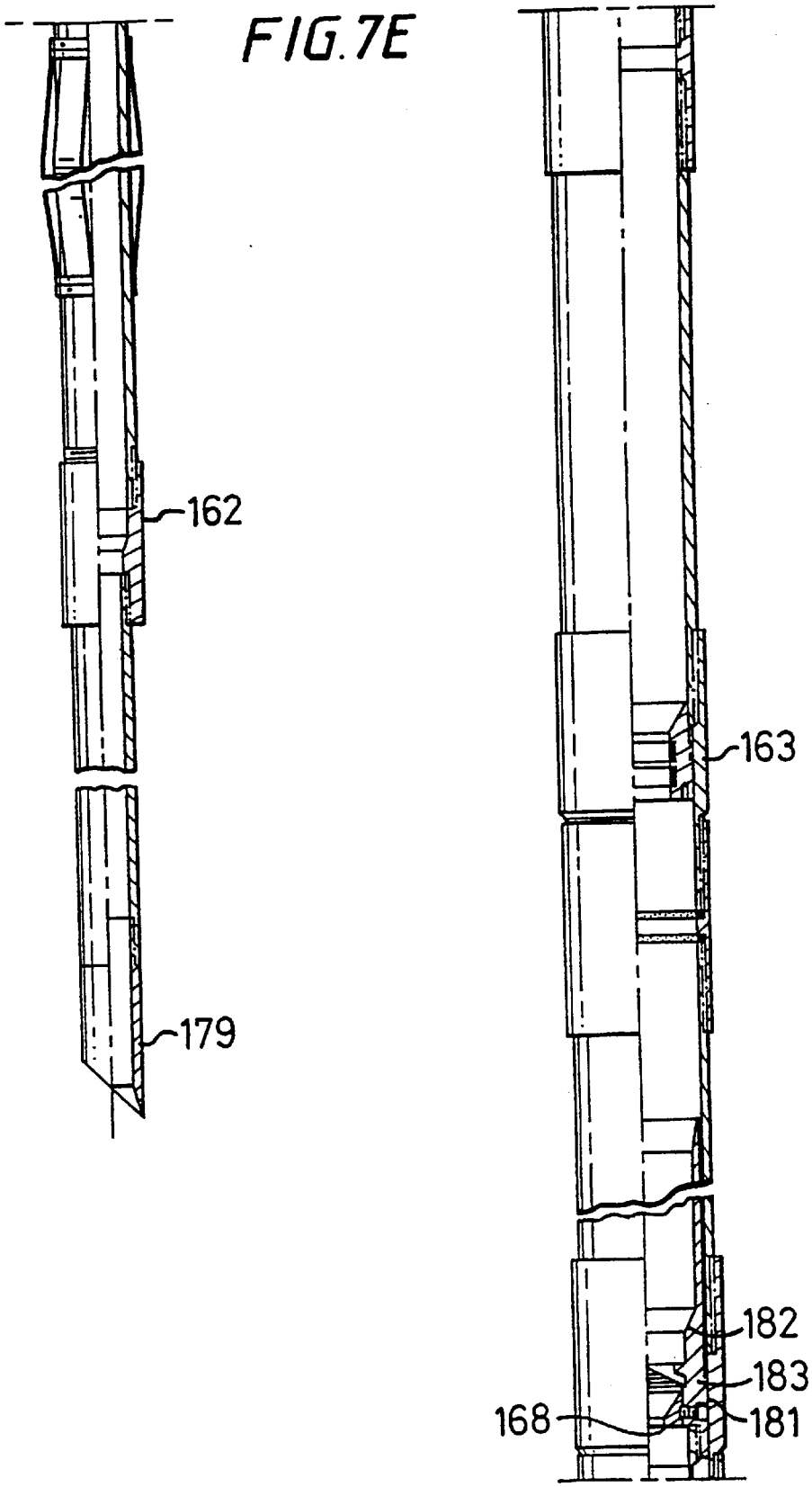
Figure 7F:
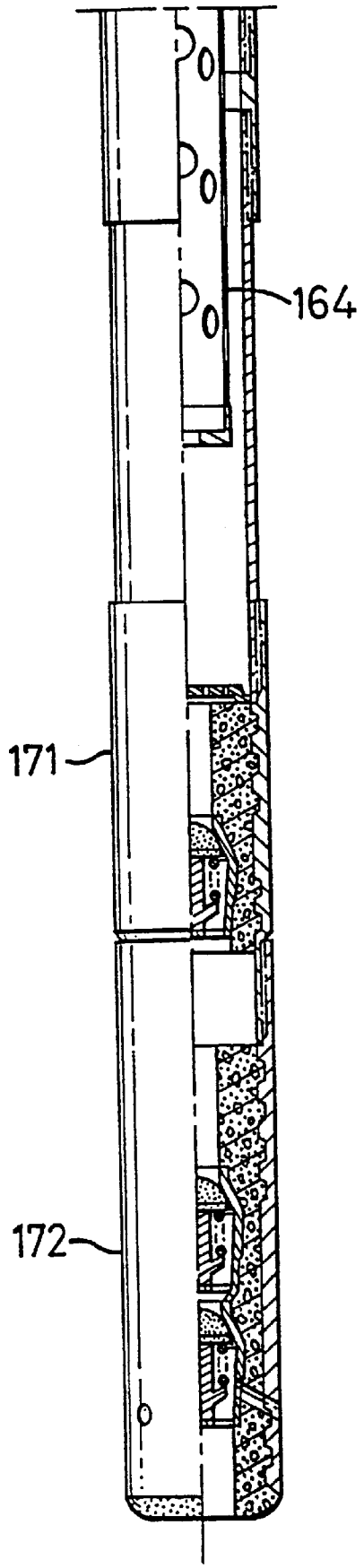
Figure 8B:
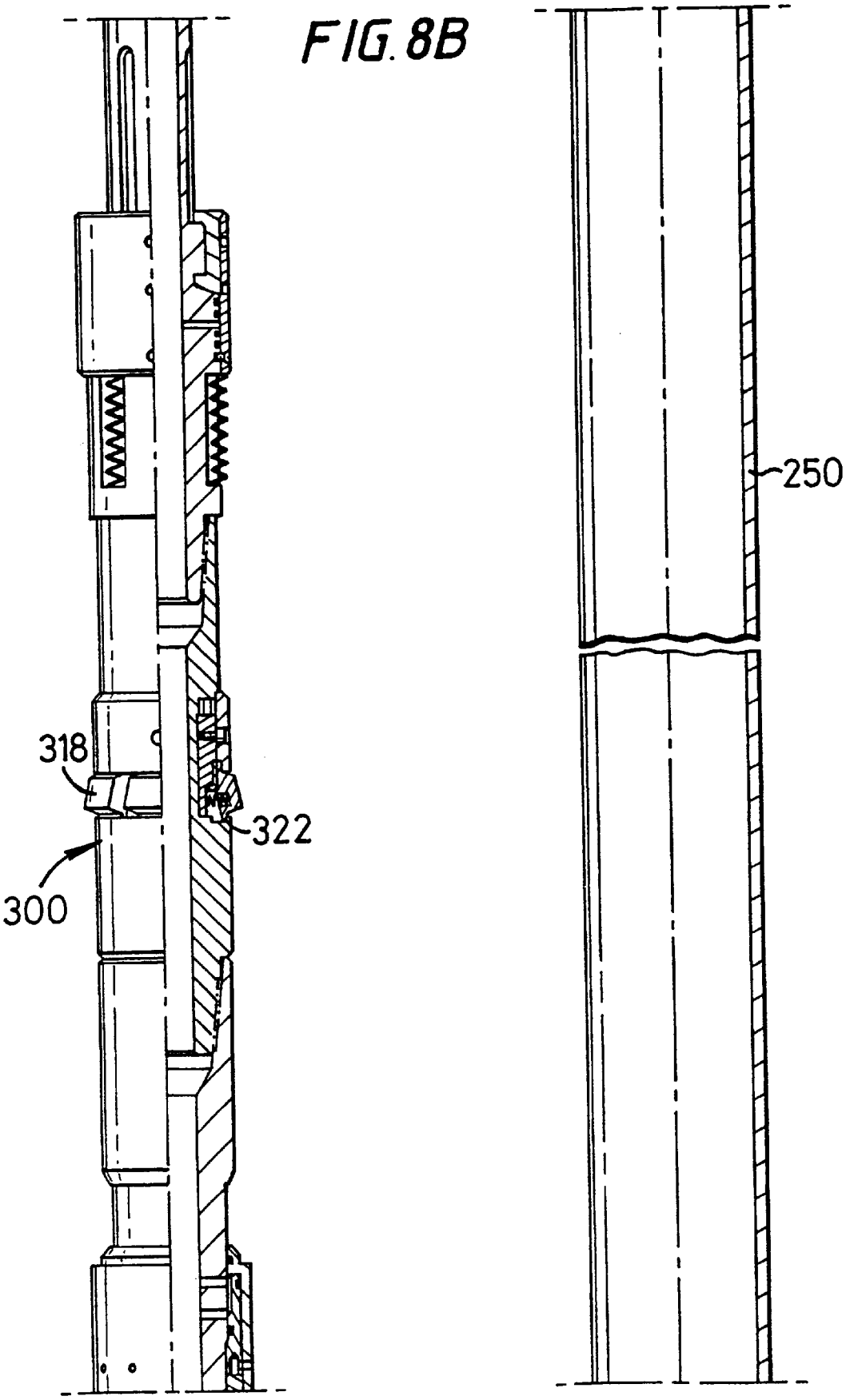
Figure 8C:
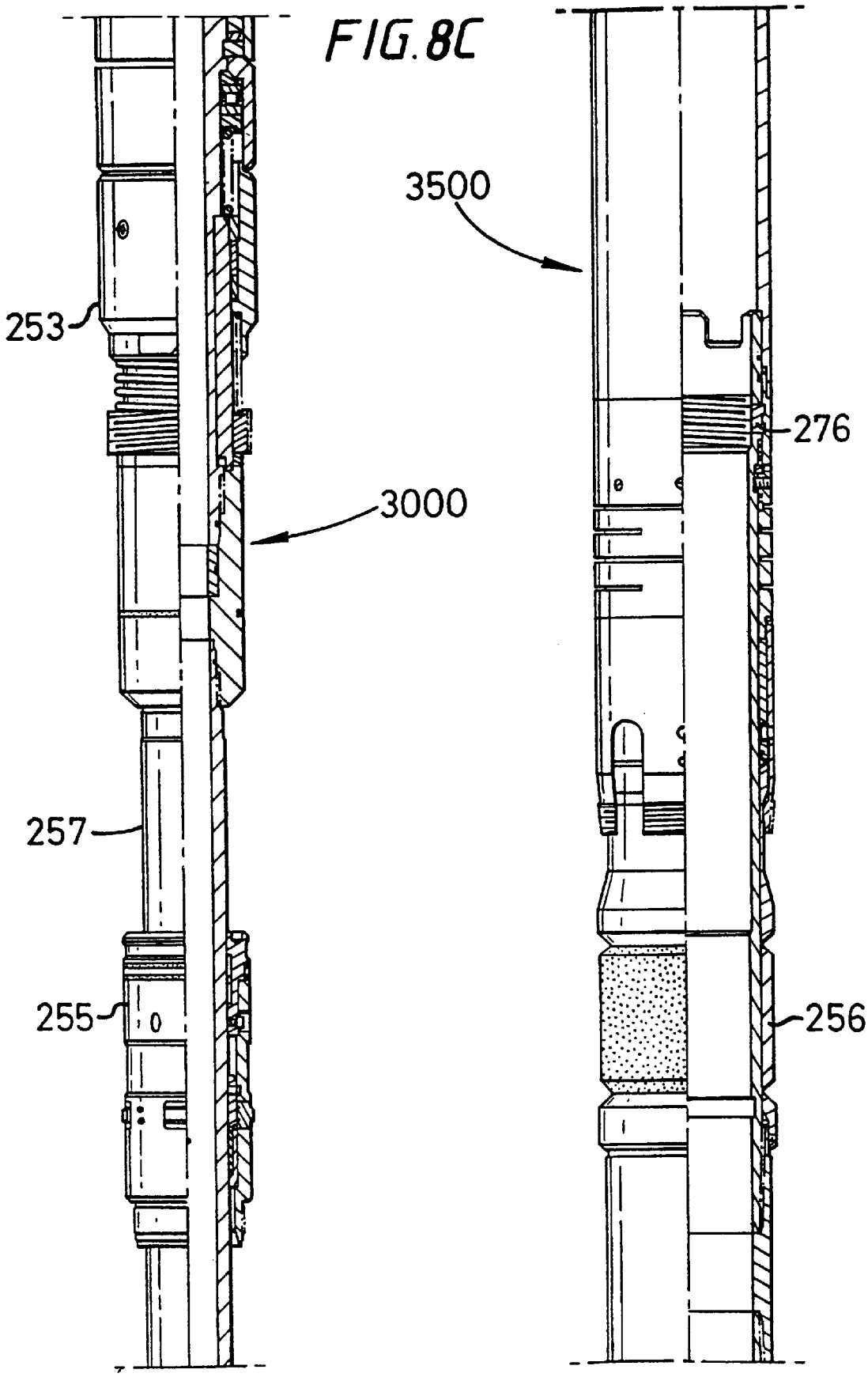
Figure 8D:
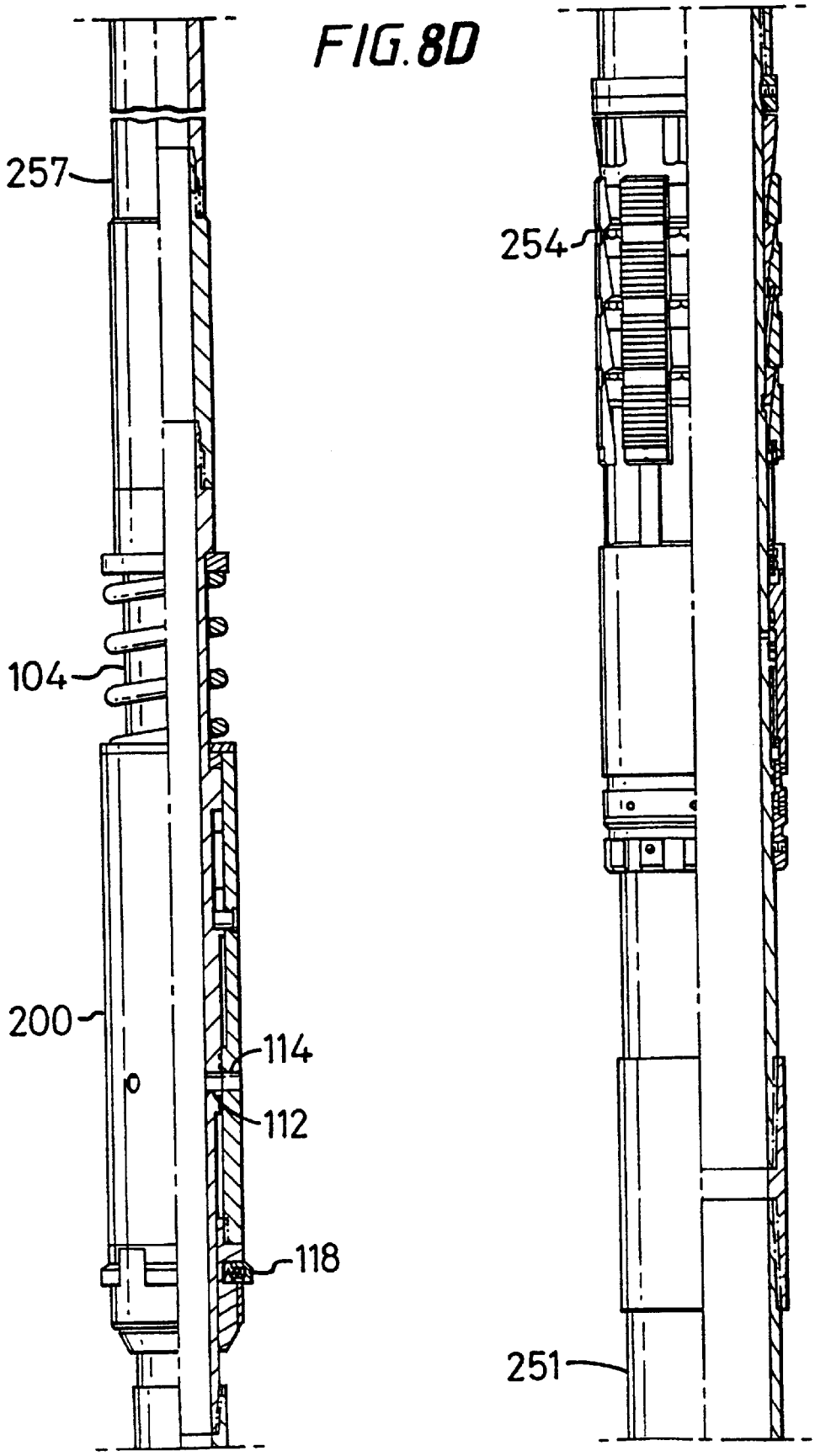
Figure 8E:
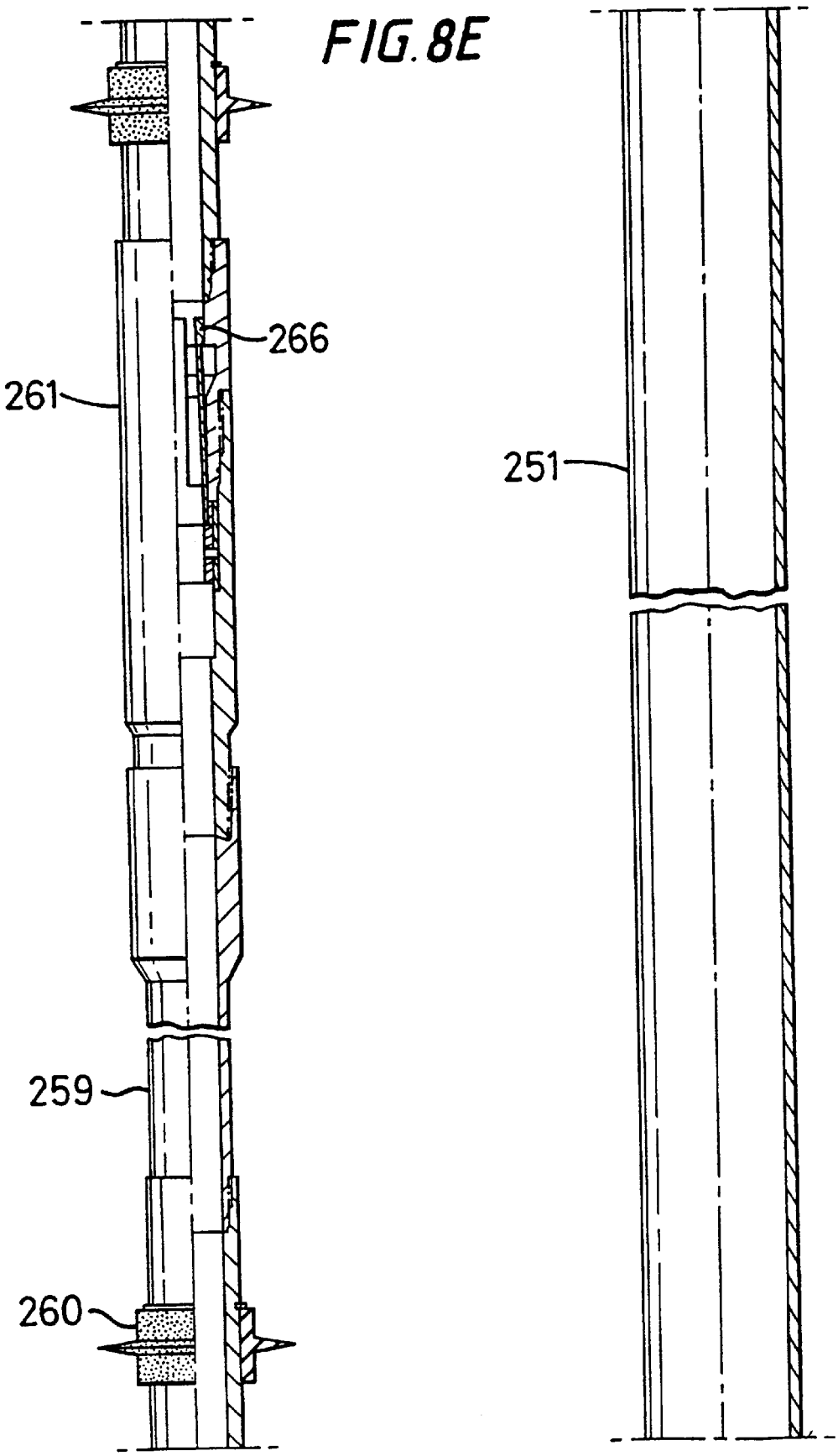
Figure 8F:
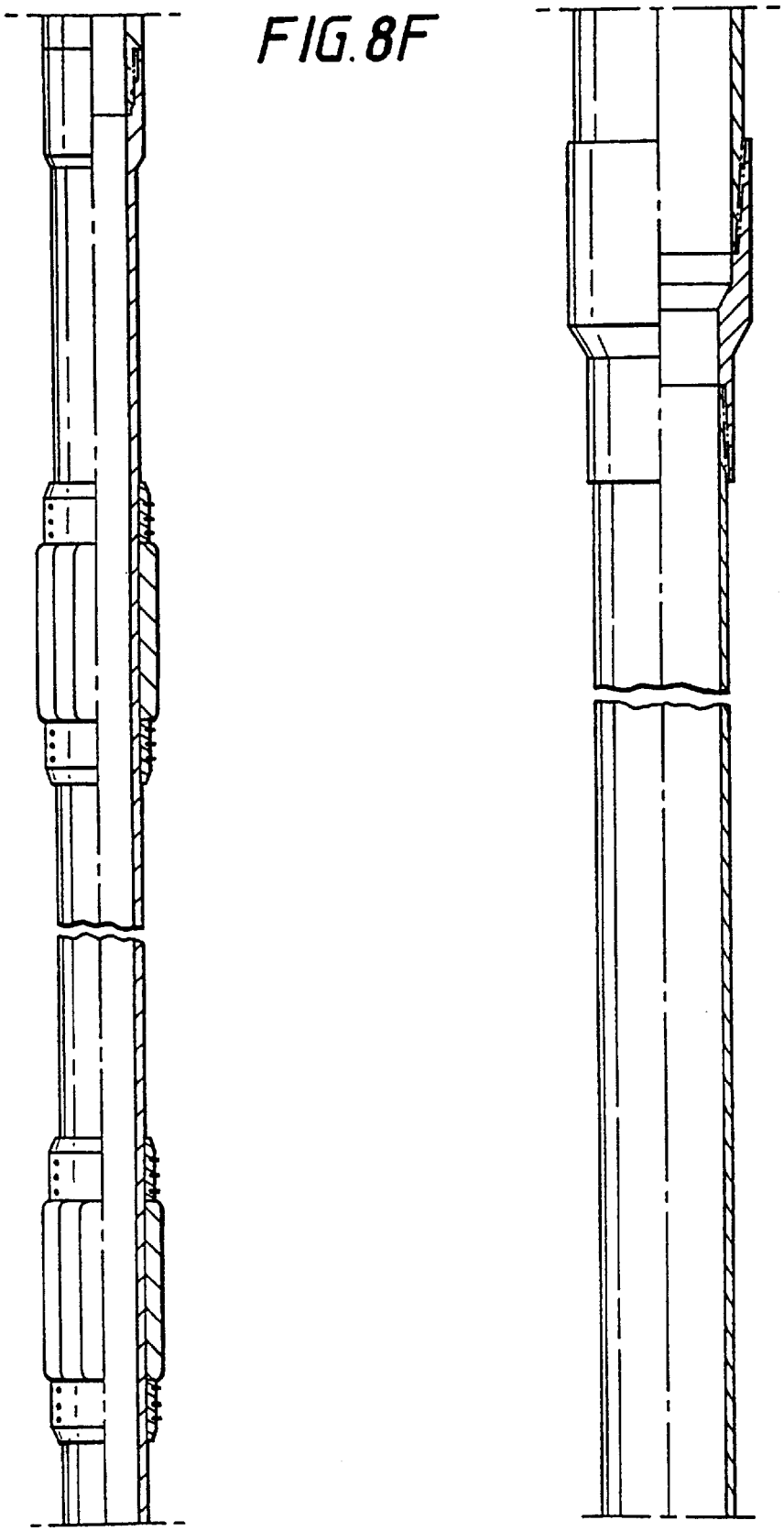
Figure 8G:
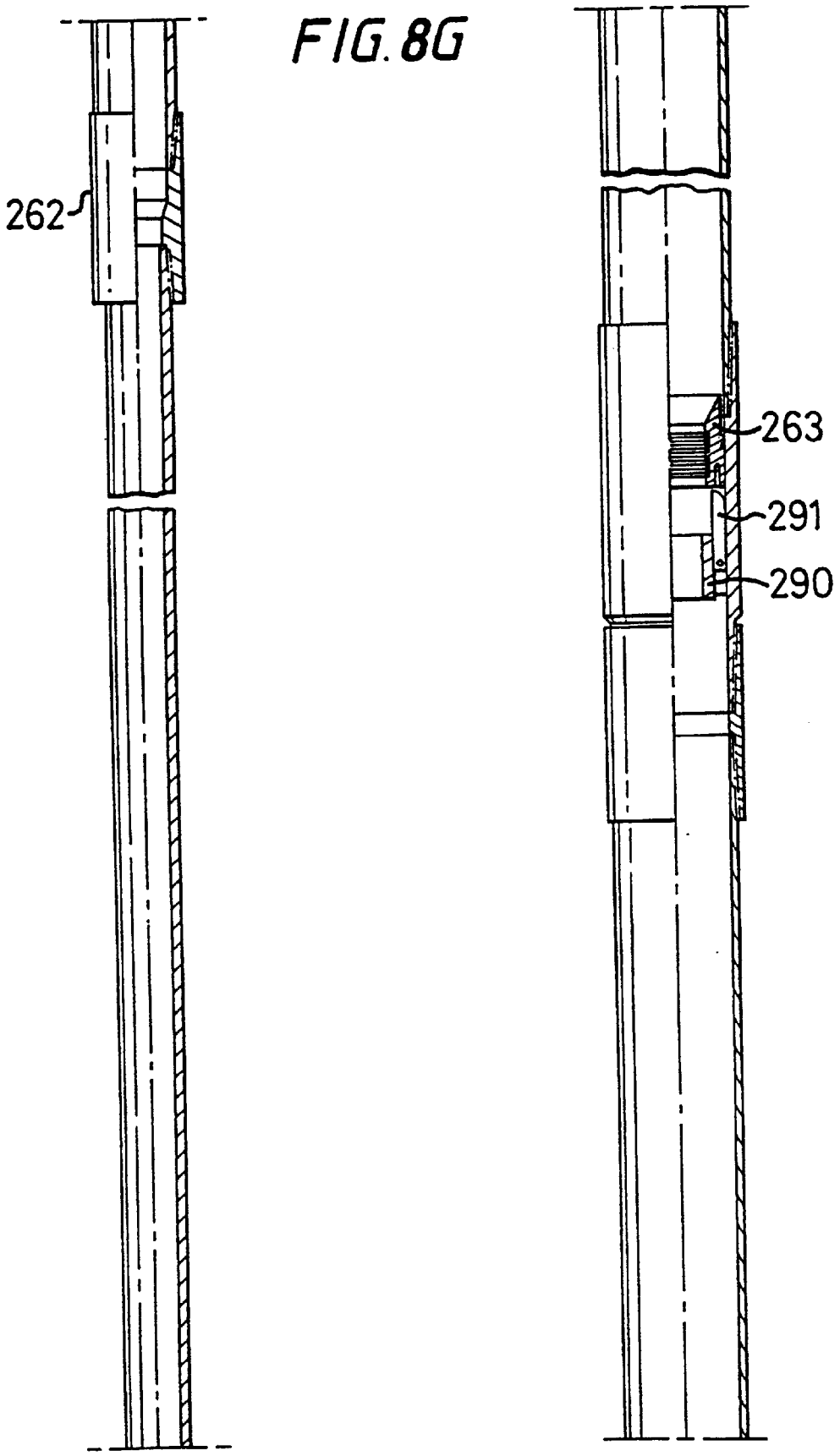
Figure 8H:
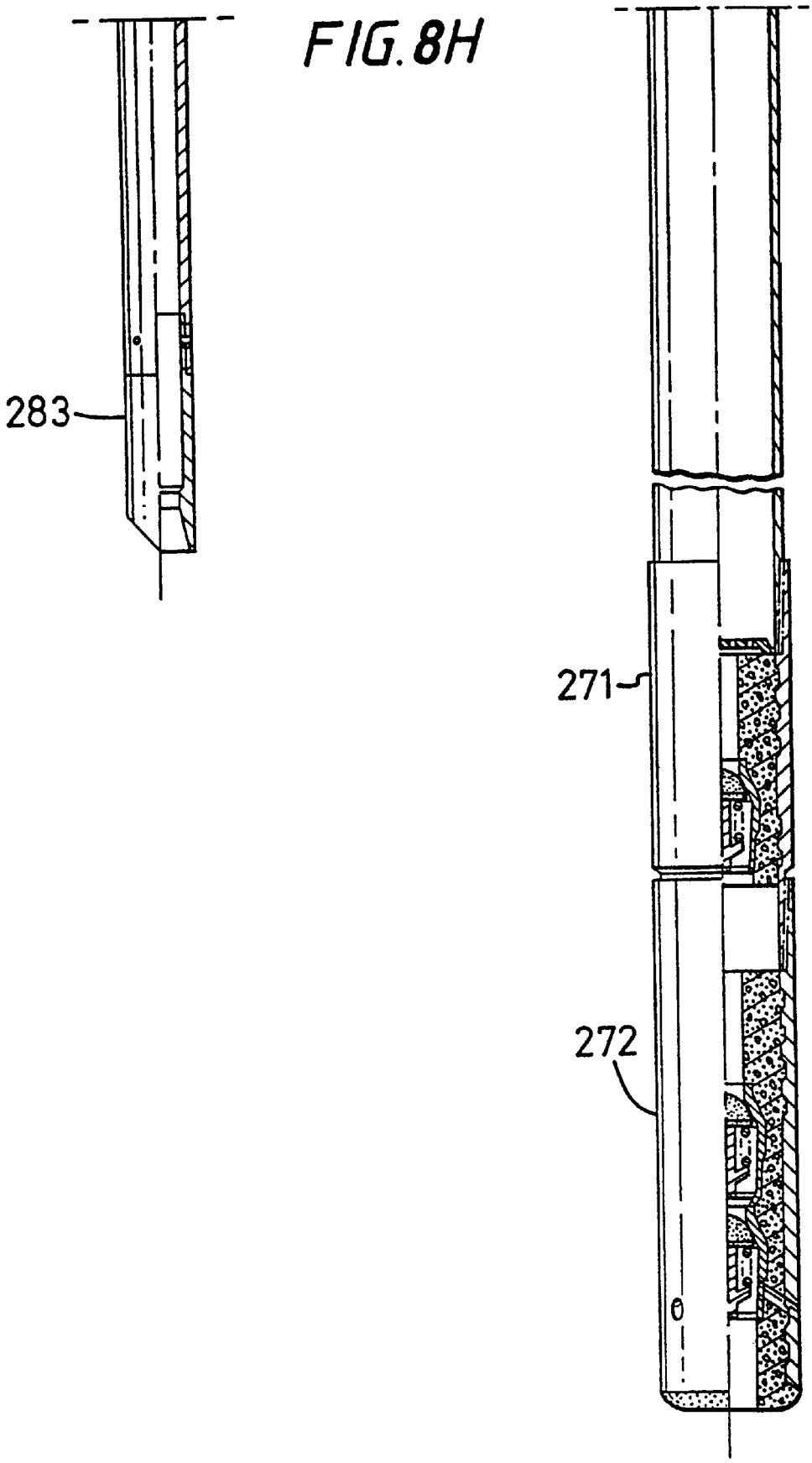
Figure 9A:
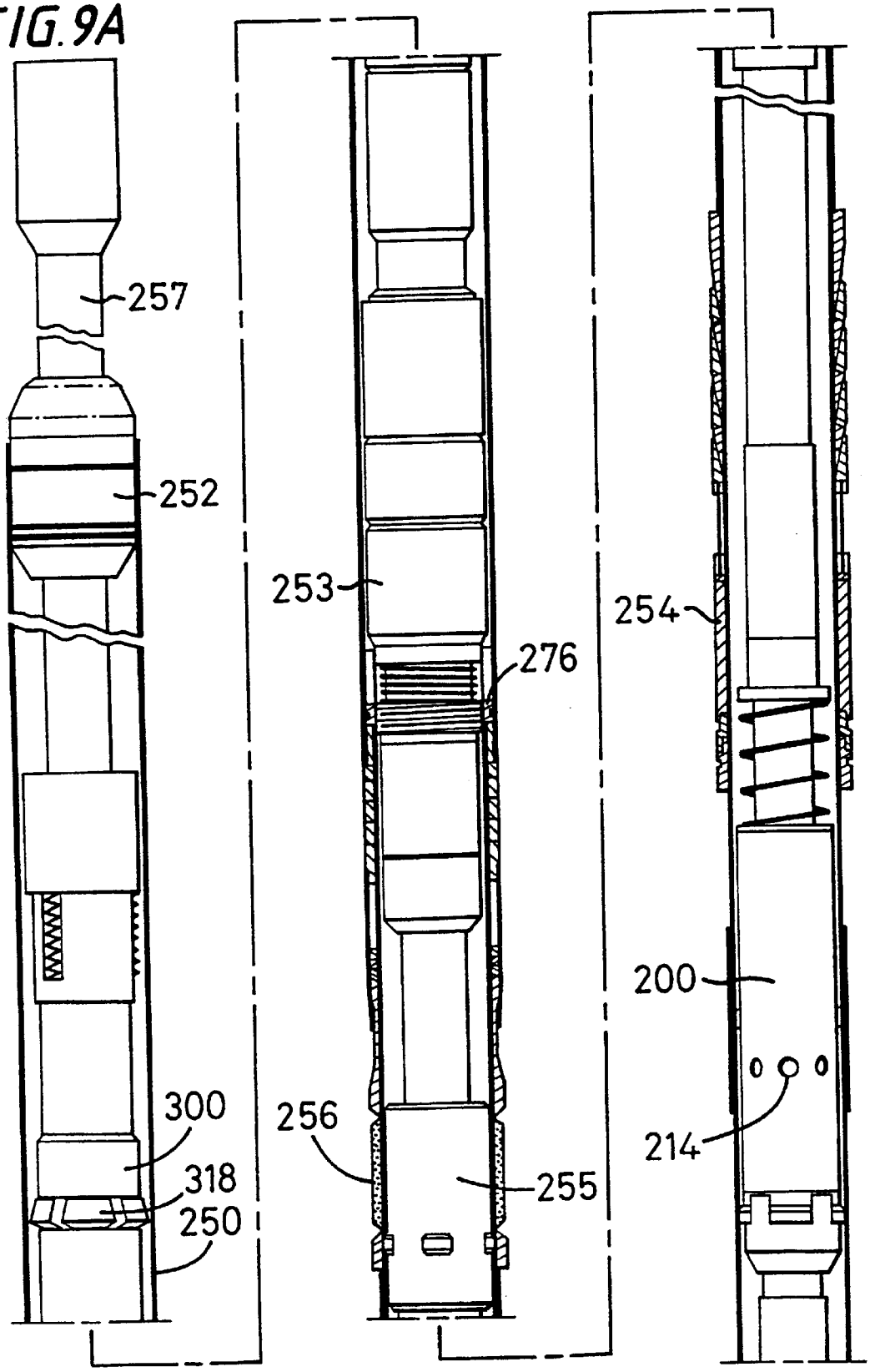
Figure 9B:
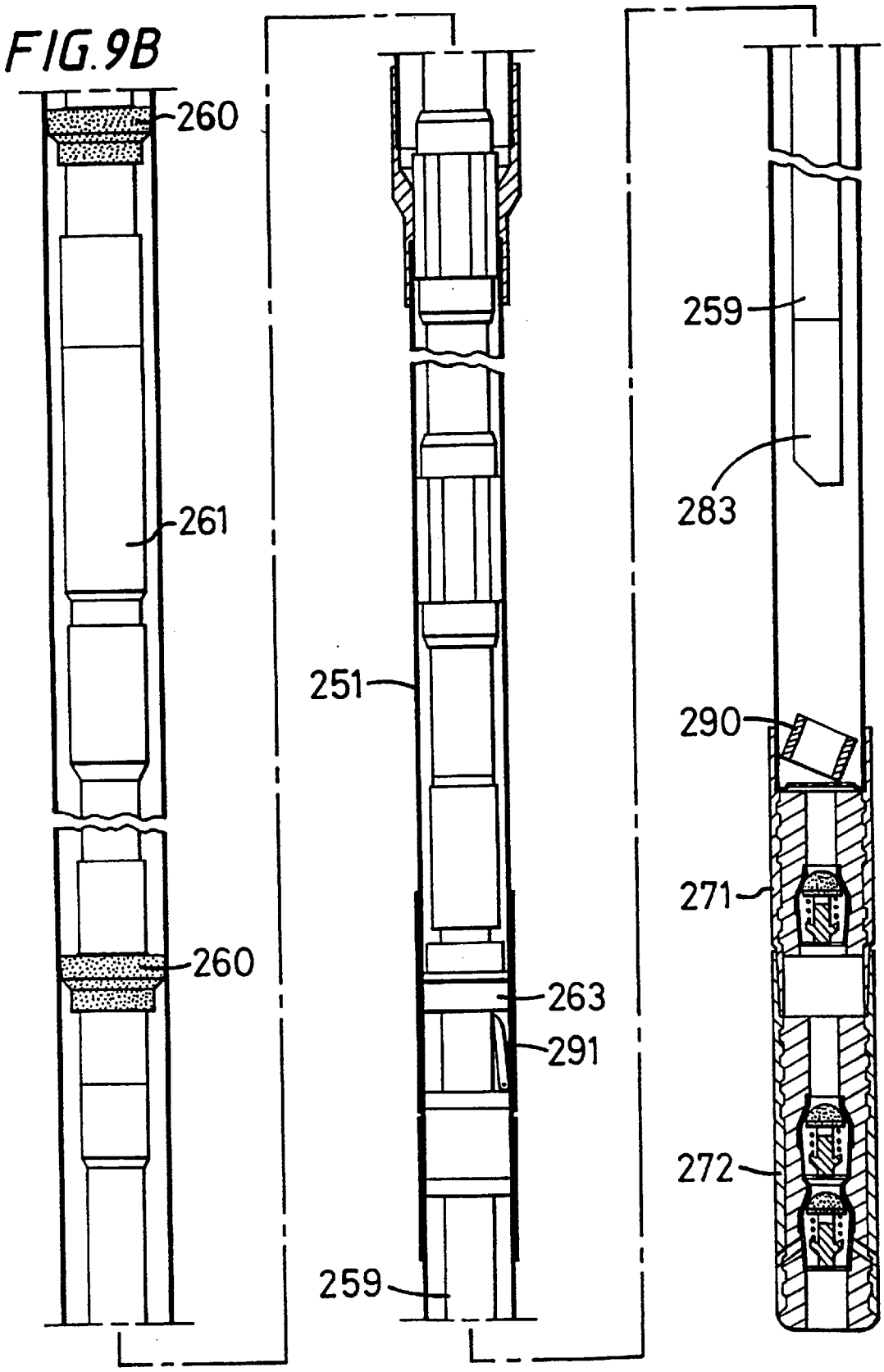
Figure 13:
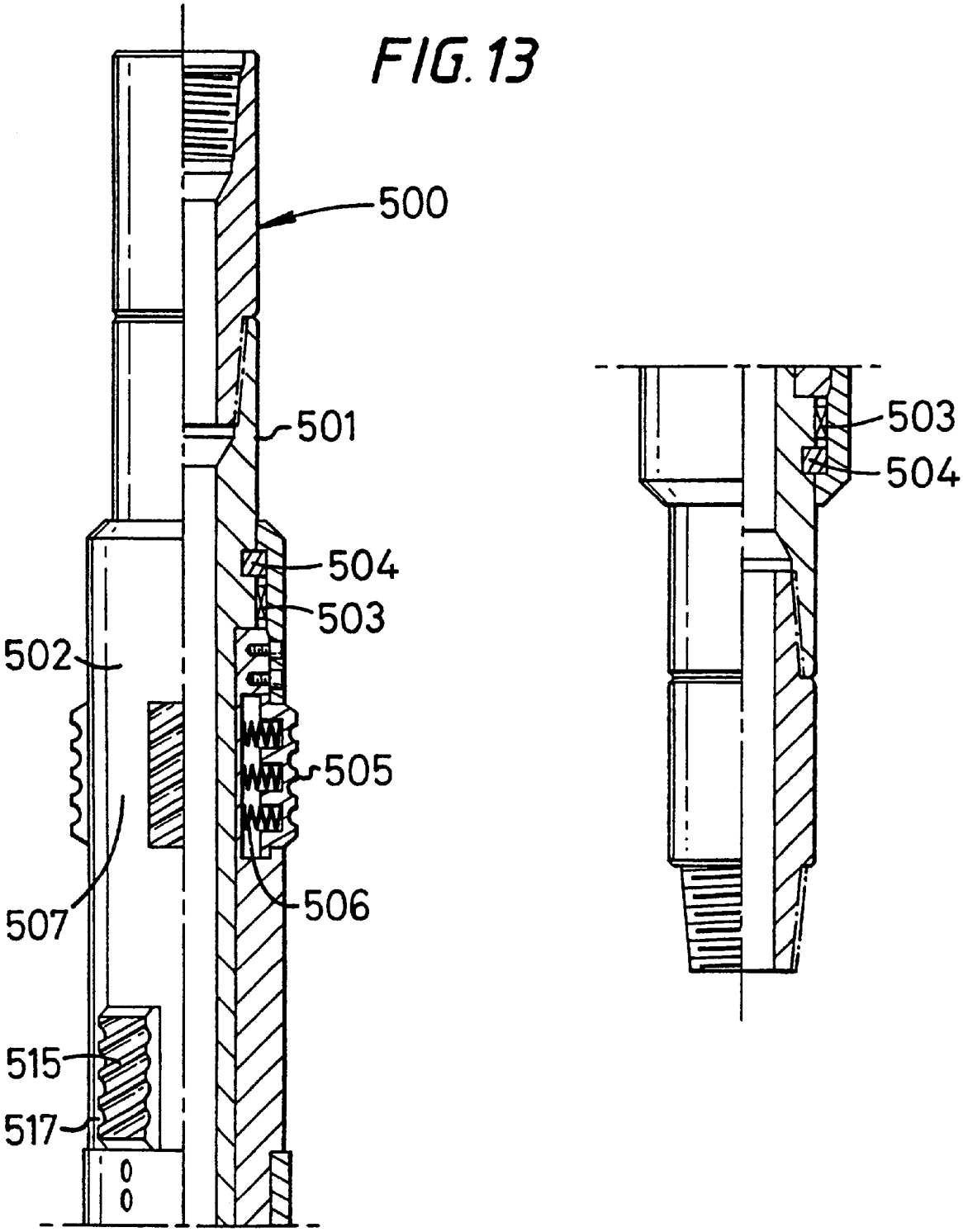

FIGS. 3*a–g* (arranged on 7 sheets) Show a schematic diagram of a first embodiment of a liner hanger system in accordance with the present invention comprising a running tool and associated equipment (left) and a liner hanger assembly (right);

FIG. 4 shows, to an enlarged scale, a packer which forms part of the liner hanger assembly of FIG. 3;

FIG. 5 shows a side view of part of a second embodiment of a running tool in accordance with the invention, partly in cross-section;

FIG. 6 shows a profile of an indexing channel used in the running tool shown in FIG. 5;

FIGS. 7*a–f* (arranged on 6 sheets) show a schematic diagram of a second embodiment of a liner hanger system in accordance with the present invention comprising a running tool and associated equipment (left) and a liner hanger assembly (right);

FIGS. 8*a–h* (arranged on 8 sheets) show a schematic diagram of a third embodiment of a liner hanger system in accordance with the present invention comprising a running tool and associated equipment (left) and a liner hanger assembly (right);

FIGS. 9*a–b* to 12*a–c* show a simplified schematic diagram of the liner hanger system as shown in FIGS. 8*a–h* assembled and in a first, second, third and fourth position respectively;

FIG. 13 shows a side view, partly in section, of a casing scraper according to another aspect of the invention.

Figure 1:
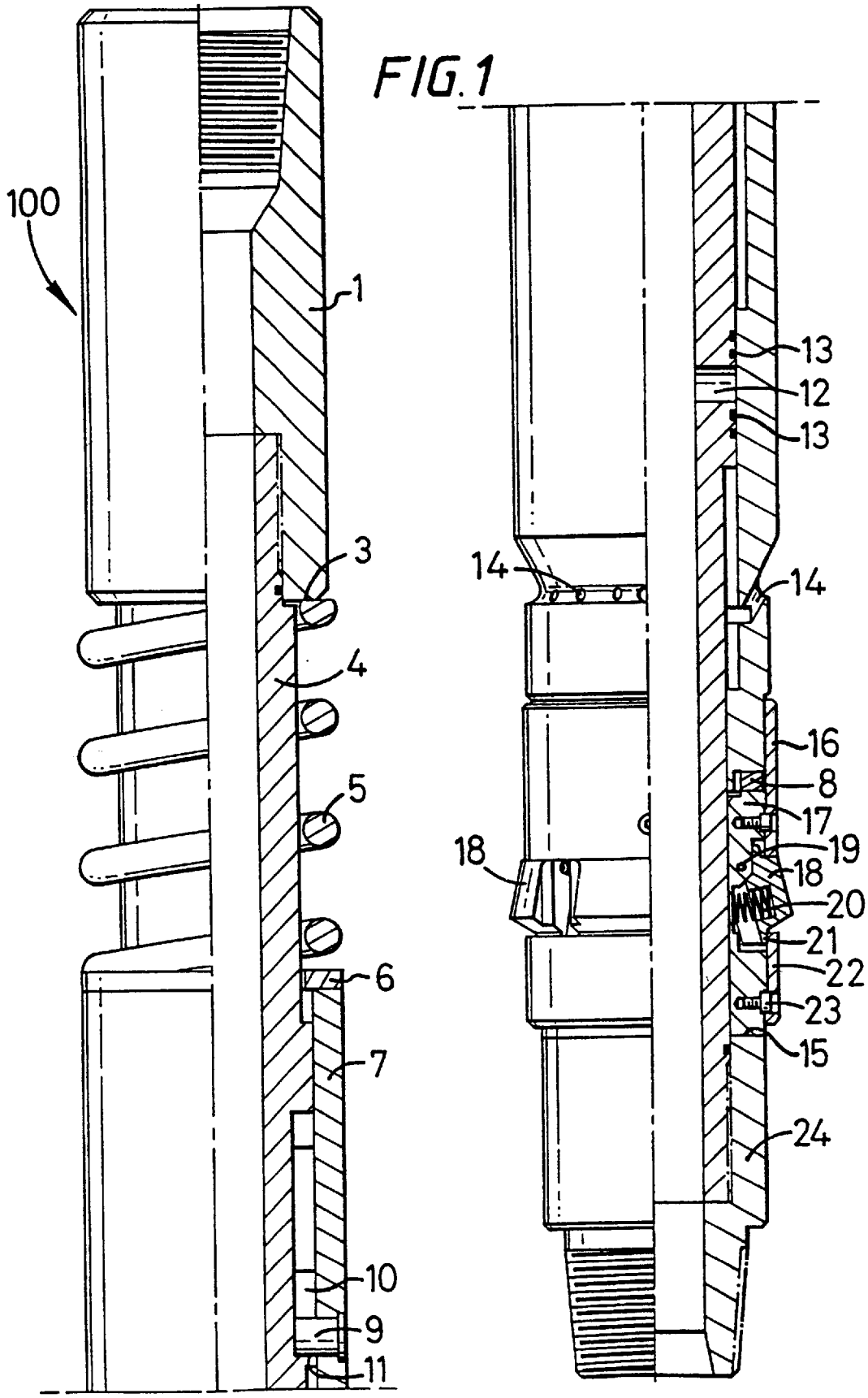
FIG. 1 shows a side view of part of a first embodiment of a running tool in accordance with the present invention, partly in cross-section.

Referring to FIG. 1, there is shown a rotatable packer actuator which is generally identified by the reference numeral 100.

The rotatable packer actuator 100 comprises a coupling 1 to which is connected a hollow mandrel 4.

A spring 5 is arranged circumjacent the hollow mandrel 4. The upper end of the spring 5 bears against shoulder 3 of coupling 1 and the lower end of the spring 5 bears against a bearing ring 6.

The bearing ring 6 is slidably mounted on the hollow mandrel 4 and presses against the upper end of a valve sleeve 7. A cylindrical roller thrust bearing 8 is located at the lower end of the valve sleeve 7. The valve sleeve 7 is both rotatable about the hollow mandrel 4 and movable longitudinally thereof. The spring 5 biases the valve sleeve 7 away from coupling 1.

Figure 2:
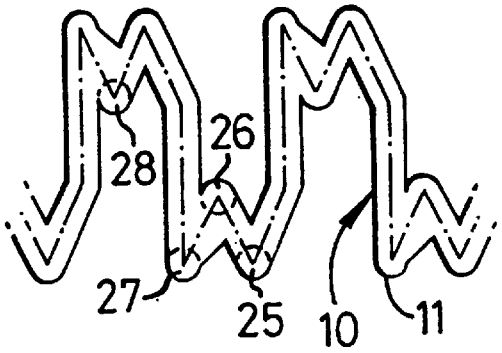
FIG. 2 shows a profile of an indexing channel used in the running tool shown in FIG. 1.

An indexing pin 9 extends radially inwardly from the valve sleeve 7 and is located in an indexing channel 10 which is milled or otherwise formed in or on the hollow mandrel 4. The path of the indexing channel 10 is shown in FIG. 2. The spring 5 biases the indexing pin 9 against an irregular surface 11 of the indexing channel 10.

Ports 12 are arranged in a circumferential ring about hollow mandrel 4. Circumferential seals 13 are located both above and below ports 12. Directional ports 14 are arranged in a circumferential ring about valve sleeve 7.

At the lower end of valve sleeve 7 there is a thrust ring 16 which retains the cylindrical roller thrust bearing 8. The thrust ring 16 is held in relation to an actuator sleeve 17 by inset screws. A lower part of the thrust ring 16 projects across a part of dogs 18.

Dogs 18 are arranged in a circumferential ring about actuator sleeve 17. Each dog 18 is located on a pin 19 and movable thereabout. Each dog 18 is radially biased away from the actuator sleeve 17 by a dog spring 20. Each dog 18 is provided with a lower lip 21 which extends beneath a retainer ring 22 which is disposed about the lower end of the actuator sleeve 17 and held in relation thereto by inset screws 23.

The retainer ring 22 limits the maximum movement of each dog 18 about its pin 19.

The bottom of hollow mandrel 4 is connected to an adaptor 24.

Referring now to FIG. 3, a schematic diagram of a liner setting system is shown incorporating the rotatable packer actuator 100 as shown in FIG. 1.

By way of outline the left hand side of FIG. 3 shows a running tool whilst the right hand side of the drawing shows a liner hanger assembly. The liner hanger assembly which is generally identified by reference numeral 1500 comprises a liner 51, a liner hanger 54, a packer 56 and a polished bore receptacle 50 all of which remain in the well after the liner has been set in position. In contrast the running tool is used to lower the liner hanger assembly into position and is eventually recovered. The running tool, which is generally identified by the reference numeral 1000 comprises a stinger 59, a retractable ball seat sub 61, a cement wiper sub 60, a pressure port straddle 58, a pack-off bushing 55, a setting tool 53, the rotatable packer actuator 100 and a floating junk bonnet 52.

In use, the running tool 1000 is loaded into the liner hanger assembly 1500.

In order to load the rotatable packer actuator 100 the dogs 18 are pushed radially inwardly to enable them to enter the polished bore receptacle 50. When the rotatable packer actuator 100 is loaded, the dogs 18 partially open radially outwardly but are prevented from maximum extension by the internal surface of the polished bore receptacle 50.

When loaded the packer 56 accommodates the pack-off bushing 55, the setting tool 53 and the rotatable packer actuator 100. It is closed by the junk bonnet 52, which is preferably of the kind disclosed in GB-A-2 284 439, which is incorporated herein for all purposes.

A pressure port straddle 58 is arranged beneath the pack-off bushing 55 in the stinger 59 in liner 51 and in close proximity to the liner hanger 54. A cement wiper sub 60 is provided below the pressure port straddle 58, and retractable ball seat sub 61 below that. A no-go sub 62 and a stinger pack off 63 are arranged above a ported stinger 64 which is located at the bottom of the stinger 59 which can be several hundred meters below the liner hanger 54.

The rotatable packer actuator 100 is arranged below the junk bonnet 52 and above the setting tool 53. The annulus between the tools and the polished bore receptacle 50 and between the junk bonnet 52 and the pack-off bushing 55 is filled with hydraulic fluid which hydraulically locks the junk bonnet 52 to the polished bore receptacle 50. The stinger pack off 63 is provided near the bottom of the liner 51 to provide a seal in the annulus between the stinger 59 and the liner 51. The liner 51, the polished bore receptacle 50, the junk bonnet 52 and the enclosed tools are then lowered into a wellbore through a casing string (not shown) on a tool string (not shown). When the liner hanger 54 reaches a predetermined point near the lower end of the casing, for example 152 m (500 feet) above the lower end of the casing string, lowering is ceased.

The liner 51 is hung by setting the liner hanger 54 which is hydraulically activated via the pressure port straddle 58 by the following steps.

Firstly dropping a setting ball 65 through the drill string, through tubular member 57 and through the stinger 59 until the setting ball 65 lands on a seat 66 of retractable ball seat sub 61 to form a blockage in the stinger 59.

Secondly, fluid is pumped down the drill string through the tubular member 57 and through the stinger 59, but is prevented from going further down the stinger 59 by the blockage. The fluid is forced through ports 67 in the pressure port straddle 58. The stinger pack-off 63 prevents the fluid passing down the annulus formed by the stinger 59 and the liner 51. The annulus between the stinger pack off 63 and the pack-off bushing 55 fills with the fluid under high pressure of approximately 100 bar (1500 psi) and sets the liner hanger 54 hydraulically in a known manner such as that described in co-pending GB-A-96 00103.7, which is incorporated herein for all purposes. As the pressure builds up to approximately 172 bar (2500 psi), the seat 66 of the retractable ball seat sub 61 moves downwardly and divides thereby allowing setting ball 65 to drop to the bottom of the ported stinger 64 to a bull plug 68.

The drill pipe (not shown) and the upper part of the tubular member 57 are now released from immediate longitudinal connection with the liner 51 by use of setting tool 53. This is conventionally achieved by unscrewing the screwed connection between the packer 56 and the setting tool 53. The drill string can now be raised a few feet and lowered without liner weight. This shows the well operator that the weight of the liner 51 is carried by the liner hanger 54.

The liner 51 is then cemented in place by pumping a predetermined quantity of cement from the surface down through the drill string, through tubular member 57 and through the stinger 59 and forced out through ports in the ported stinger 64. The stinger pack off 63 prevents cement from rising inside the liner 51 and hence the cement is forced down through a float collar 71 and a float shoe 72 and then up through the annulus between the liner 51 and the wellbore (not shown) and up through a second annulus formed between the liner 51 and the casing (not shown) and then past the polished bore receptacle 50. Any excess cement simply builds up in the casing above the junk bonnet 52. The cement is followed down the drill string by dart 73 which lands in a shearable seat 74 in no go sub 62 above the port stinger 64. Pressure is now built up to shear out the shearable seat 74 so that it and the dart 73 land on the bull plug 68 below the ports in the ported stinger 64.

The junk bonnet 52 is then released from the polished bore receptacle 50 and the drill string, tubular member 57 and stinger 59 are raised, lifting the rotatable packer actuator 100 until it is above the top 75 of the polished bore receptacle 50.

Raising the drill string also lifts the setting tool 53 which allows packer dogs 76 in packer 56 to move inwardly and out of longitudinal alignment with the polished bore receptacle 50 shown in FIG. 4.

Referring back to FIG. 1, the dogs 18 now extend outwardly from the central axis of the rotatable packer actuator 100 and are retained by lip 21 on retaining ring 22 (as shown).

Drill string weight is applied. The indexing pin 9 follows the channel 10 and locates in position 26. Ports 12 remain sealed by valve sleeve 7.

The weight applied to the polished bore receptacle 50 pushes the polished bore receptacle 50 down and activates packer 56 which seals the annulus between the liner 51 and the casing. This is carried out before the cement in the annulus between the polished bore receptacle 50 and the casing and between the liner 51 and the casing has had time to set.

The pressure port straddle 58 has an outer sleeve 69 which, upon lifting the tubular member 57 and the pressure port straddle 58 against the bottom of pack-off bushing 55, closes the ports 67. Collets 70 prevent the ports 67 from being reopened. Continued upward pull releases the pack-off bushing 55. The drill string is then raised a small distance. The indexing pin 9 follows the channel 10 and locates in position 27. Ports 12 remain closed by valve sleeve 7.

The drill string is then lowered and raised. The 2 indexing pin follows the channel 10 and locates in position 28. Ports 12 are now aligned with directional ports 14. Circulation can now begin by pumping mud or sea water or any suitable circulation liquid down the drill pipe through the hollow mandrel 4 and through aligned ports 12 and direction ports 14. The cement wiper sub 60 forms a barrier in the annulus between the stinger 59 and the liner 51 and thereby substantially prevents any cement from falling into the liner 51.

Reverse circulation can also take place by pumping mud through the annulus made by the drill pipe and the casing through the aligned directional ports 14 and ports 12 up through the hollow mandrel 4. Circulation is continued until substantially all traces of cement above the polished bore receptacle 50 have been removed thereby reducing or even obviating the need to further clean the inside of the casing at the top of the liner.

The ports 12 can be closed using the above described method. This allows circulation to continue through the bottom of the stinger 59.

The opening and closing cycle can be repeated as many times as desired.

After circulation is complete, the drill pipe and running tool 1000 are lifted out of the casing.

The directional ports 14 need not be directional, although this is preferred.

Referring now to FIG. 5, there is shown a pressure port straddle which is generally designated by reference numeral 200.

Like parts will be referred to with like reference numerals with regard to FIGS. 1 and 2 in the one hundred series.

The pressure port straddle 200 comprises a hollow mandrel 104 having a coupling 102. A spring retainer 103 is fixed to the hollow mandrel 104. A spring 105 is arranged circumjacent the hollow mandrel 104. The upper end of the spring, 105 bears against spring retainer 103 and the lower end of the spring 105 bears against bearing ring 106.

The bearing ring 106 is arranged to bear on the upper end of a valve sleeve 107 which is rotatable about the hollow mandrel 104 and movable therealong. The spring 105 biases the valve sleeve 107 away from spring retainer 103.

Although a lower thrust bearing could be present it is envisaged that the upper bearing alone will be adequate to allow rotation of the valve sleeve 107 about hollow mandrel 104.

An indexing pin 109 extends from the valve sleeve 107 and is located in an indexing channel 110. Indexing channel 110 is milled or otherwise formed in the hollow mandrel 104. The path of the indexing channel 110 is shown in FIG. 6. The spring 105 biases the indexing pin 109 against an irregular surface 111 of the indexing channel 110.

Ports 112 are arranged in a circumferential ring about hollow mandrel 104. Circumferential seals 113 are located both above and below ports 112. Sleeve ports 114 are arranged in a circumferential ring about valve sleeve 107.

At the lower end of valve sleeve 107 there is a thrust ring 116 held in relation to the valve sleeve 107 by inset screws. A lower part of the thrust ring 116 projects across a part of dogs 118.

Dogs 118 are arranged in a circumferential ring about valve sleeve 107. Each dog 118 is located on a pin 119 and movable thereabout. Each dog 118 is radially biased away from the valve sleeve 107 by a dog spring 120. A lower lip 121 is integral with each dog 118. A retainer ring 122 is disposed about the lower end of valve sleeve 107 and held in relation to the valve sleeve 107 by inset screws 123.

The retainer ring 122 projects across the lip 121 of each dog 118 and thereby limits the movement of each dog 118 about pin 119 to a maximum extension.

Referring now to FIG. 7, a schematic diagram of a liner hanger system is shown incorporating the pressure port straddle 200 as shown in FIG. 5.

In use, the pressure port straddle 200 is loaded into a liner 151. The dogs 118 are pushed radially inwardly towards the central axis of the pressure port straddle 200. When the pressure port straddle 200 is loaded, the dogs 118 partially open radially outwardly but are prevented from maximum extension by the internal surface of the liner 151.

The polished bore receptacle 150 is also loaded with a number of other tools used in the hanging and setting of the liner 151 including a junk bonnet 152, a packer actuator 300, a setting tool 153 and a pack-off bushing 155. The packer actuator 300 and the setting tool 153 are used to actuate the packer 156. The tools depend from a drill string (not shown) which is connected to an inner string at the top of which is a tubular member 157.

The pressure port straddle 200 is arranged beneath the pack-off bushing 155 on a stinger 159 in liner 151 and in close proximity to a liner hanger 154. A pick up sub 160 is provided above the pressure port straddle 200 and a retractable ball seat sub 161 below the pressure port straddle 200. A no-go sub 162 is located towards the bottom of stinger 159. A stinger pack off 163 is arranged above a dart landing collar 183 which is located at the top of the ported tube 164.

The packer actuator 300 is arranged below the junk bonnet 152 and above the setting tool 153. The annulus between the tubular member 157 and the polished bore receptacle 150 and between the junk bonnet 152 and the pack-off bushing 155 is filled with hydraulic fluid which locks the junk bonnet 152 in the polished bore receptacle 150. The stinger pack off 163 is provided near the bottom of the liner 151 to provide a seal in the annulus between the stinger 159 and the liner 151. The liner 151, the polished bore receptacle 150, the junk bonnet 152 and the enclosed tools are then lowered into a wellbore through a casing string (not shown). When the liner hanger 154 reaches a predetermined point near the lower end of the casing string lowering is ceased.

The liner 151 is hung by setting the liner hanger 154 which is hydraulically activated by the following steps.

Firstly dropping a setting ball 165 through the drill string through tubular member 157 and through the stinger 159 until the setting ball 165 lands on a seat 166 in the retractable ball seat sub 161 to form a blockage in the stinger 159.

Secondly, fluid is pumped down the drill string through the tubular member 157 and through stinger 159, but is prevented from going further down the stinger 159 by the blockage. The fluid is forced through ports 112 in the pressure port straddle 200. The pack-off bushing 155 prevents the fluid passing up the annulus formed by the stinger 159 and the polished bore receptacle 150. The annulus between the pack-off bushing 155 and the stinger pack-off 163 fills with the fluid under high pressure of approximately 100 bar (1500 psi) and sets the liner hanger 154 hydraulically in a known manner. As the pressure builds up to approximately 172 bar (2500 psi), the seat 166 of the retractable ball seat sub 161 moves after breaking some shear pins, divides, and allows setting ball 165 to drop to the ball seat 168 into the ported tube 164.

The drill pipe (not shown) and the upper part of the tubular member 157 are now released from immediate longitudinal connection with the liner 151 by use of setting tool 153. The drill string can now be raised and lowered a few feet without liner weight. This shows the well operator that the weight of the liner is carried by the liner hanger.

The liner 151 is then cemented in place by releasing a first dart 180 followed by a predetermined quantity of cement from the surface down through the drill string, through the tubular member 157 and through the stinger 159. The first dart 180 lands in ported tube 164. The cement is forced out of mule shoe 179, into the annulus beneath the stinger pack off 163 and through ports in a ported tube 164. The stinger pack off 163 prevents cement from rising inside the liner 151 and hence the cement is then forced down through a float collar 171 and a float shoe 172 and then up through the annulus between the liner 151 and the wellbore (not shown) and up through a second annulus formed between the liner 151 and the casing and then past the polished bore receptacle 150. Any excess cement simply builds up in the casing above the junk bonnet 152. The cement is pumped down by a second plug 173 which lands and seals in seat 183 above the ported tube 164.

Some cement may pass into the annulus between the tubular member 159 and the liner 151 through ports 112, however, this will be minimal as fluid in the annulus would substantially prevent this from occurring. Circulation, which will be explained hereafter will remove any such cement that does pass into the annulus.

The junk bonnet 152 is then released from the polished bore receptacle 150. As the drill string is raised lifting the packer actuator 300 until it is above the top 75 of the polished bore receptacle 150. The pack-off bushing 155 substantially prevents cement flowing into the liner 151 at this time.

Raising the drill string also lifts the setting tool 153 which allows the packer dogs 176 in packer 156 to move inwardly and out of longitudinal alignment with the polished bore receptacle 150. Dogs 218 now extend outwardly from the sleeve 207 of the packer actuator 300 and are retained by lip 221.

Drill string weight is applied. The weight is transferred to the polished bore receptacle 150, which moves the polished bore receptacle 150 down and activates the packer 156 which seals the annulus between polished bore receptacle 150 and the casing. This is carried out before the cement in the annulus between the polished bore receptacle 150 and the casing has had time to set.

The drill string is then raised to remove pack-off bushing 155 from the packer 156. Circulation can now begin by pumping mud or sea water or any suitable circulation liquid down the drill pipe through the hollow mandrel 104 and through aligned ports 112 and sleeve ports 114, the bottom of the stinger having been sealed by second plug 173. An optional cement wiper sub (not shown) arranged beneath the pressure port straddle 200 would form a barrier in the annulus between the stinger 159 and the liner 151, and thereby substantially prevent any cement from falling into the majority of the is length of the liner 151. Reverse circulation can also take place by pumping mud through the annulus made by the drill pipe and the casing through the aligned ports 112 and sleeve ports 114 and up through the hollow mandrel 104. The pressure port straddle 200 can be raised further up the liner 151 and into the polished bore receptacle 150. The dogs 118 now extend outwardly from the valve sleeve 107 of the pressure port straddle 200 and are retained from maximum extension by lip 121 engaging retaining ring 122. The pressure port straddle 200 can be raised up through and above polished bore receptacle 150 while circulation continues through ports 112, and sleeve ports 114 into the polished bore receptacle 150 and into the casing (not shown) while the cement wiper sub (not shown) remains in liner 151.

The pressure port straddle 200 is then lowered and dogs 118 engage with shoulder 181 formed by the top of the liner 151. Drill string weight is then applied and released. The indexing pin 109 follows the channel 110 and locates in position 128. The valve sleeve 107 moves upwardly against spring 105 and seals port 112. As the mule shoe 179 is now raised clear of the stinger pack-off 163 circulation through the stinger 159 can now take place to clean out the annulus between the stinger 159 and the liner 151 if so desired.

Referring now to FIGS. 8*a–h,* a schematic diagram of another liner hanger system is shown incorporating the pressure port straddle 200 as shown in FIG. 5.

In use, the pressure port straddle 200 is loaded into a liner 251. The dogs 118 are pushed radially inwardly towards the central axis of the pressure port straddle 200. When the pressure port straddle 200 is loaded, the dogs 118 partially open radially outwardly but are prevented from maximum extension by the internal surface of the liner 251.

The polished bore receptacle 250 is also loaded with a number of other tools used in the hanging and setting of the liner 251 including a junk bonnet 252, a packer actuator 300, a setting tool 253 and a pack-off bushing 255. The packer actuator 300 and the setting tool 253 are used to actuate the packer 256. The tools depend from a drill string (not shown) which is connected to an inner string at the top of which is a tubular member 257.

The pressure port straddle 200 is arranged beneath the pack-off bushing 255 on the tubular member 257 in liner 251 and in close proximity to a liner hanger 254. A cement wiper sub 260 and a retractable ball seat sub 261 are located below the pressure port straddle 200. A no-go sub 262 is located towards the bottom of stinger 259 near the bottom of the liner 251. A stinger pack off 263 is arranged near the bottom of the liner 251 adjacent float collar 271 which is situated above a float shoe 272. A tubular segment 290 is arrange to hold a flap 291 open. The tubular segment 290 is initially shear pinned to the stinger pack-off 263. The shearable landing collar 283 is arranged on the lower end of stinger 259. When the stinger 259 is loaded into liner 251 the stinger 259 is guided by the stinger pack-off 263 on to the tubular segment 290. The tubular segment 290 is sheared from the stinger pack-off 263 and falls to the bottom of the liner 251. The flap 291 is now held open by the stinger 259, as shown in FIG. 9.

The packer actuator 300 is arranged below the junk bonnet 252 and above the setting tool 253. The annulus between the tubular member 257 and the polished bore receptacle 250 and between the junk bonnet 252 and the pack-off bushing 255 is filled with hydraulic fluid which hydraulically locks the junk bonnet 252 in the polished bore receptacle 250. The stinger pack-off 263 provides a seal in the annulus between the stinger 259 and the liner 251. The liner 251, the polished bore receptacle 250, the junk bonnet 252 and the enclosed tools as shown in FIG. 9 are then lowered into a wellbore through a casing string (not shown). When the liner hanger 254 reaches a predetermined point near the lower end of the casing string lowering is ceased.

The liner 251 is hung by setting the liner hanger 254 which is hydraulically activated by the following steps.

Firstly dropping a setting ball 265 through the drill string through tubular member 257 and through the stinger 259 until the setting ball 265 lands on a seat 266 in the retractable ball seat sub 261 to form a blockage in the stinger 259.

Secondly, pumping fluid down the drill string, the tubular member 257 and the stinger 259, above the blockage. The fluid is forced through ports 112 in the pressure port straddle 200. The pack-off bushing 255 prevents fluid pressure building up in the annulus formed by the tubular member 257 and the polished bore receptacle 250. The pressure in the annulus between the pack-off bushing 255 and the stinger pack-off 263 increases to approximately 100 bar (1500 psi) and sets the liner hanger 254 hydraulically in a known manner. As the pressure builds up to approximately 172 bar (2500 psi), the seat 266 of the retractable ball seat sub 261 moves after breaking a row of shear pins, the seat 266 divides and allows setting ball 265 to drop onto the float collar 271 adjacent the bottom of the liner 251.

The drill pipe (not shown) and the upper part of the tubular member 257 are now released from immediate longitudinal connection with the liner 251 by use of setting tool 253. The drill string is now raised and lowered about a meter without liner weight. This shows the well operator that the weight of the liner is carried by the liner hanger 254.

The liner 251 is then cemented in place by releasing a first dart 273 which is followed by a predetermined quantity of cement from the surface down through the drill string, through the tubular member 257 and through the stinger 259. The first dart 273 is small enough to pass through the shearable landing collar 283 and lands on the float collar 271 adjacent the bottom of liner 251. The cement is forced into the annulus beneath the stinger pack off 263. The stinger pack-off 263 prevents cement from rising inside the liner 251 and hence the cement is then forced down through a float collar 271 and a float shoe 272 and then up through the annulus between the liner 251 and the wellbore (not shown) and up through a second annulus formed between the liner 251 and the casing and then past the polished bore receptacle 250. Any excess cement simply builds up in the casing above the junk bonnet 252.

After the predetermined quantity of cement has been pumped down the drillpipe, a second dart 280 is launched. Second dart 280 comprises a sleeve 293 which is shear pinned to the rear of the body. The second dart 280 lands on a seat 294 which may form part of a casing scraper, as shown in FIG. 13. An increase in pressure will be needed in order to shear off the sleeve 293 which releases the second dart 280. This indicates to the operator that there is a fixed quantity of cement left in the inner string beneath the second dart 280 and above the float shoe 271, which could be, for instance, barrels. The operator can now predict with a degree of certainty that for example, approximately three minutes of pumping at 7 barrels per minute will be required to finish. The second plug 273 subsequently lands on shearable landing collar 283 and shears the shearable landing collar 283 from the stinger 259 or simply passes through the shearable landing collar 283.

Some cement may pass into the annulus between the tubular member 257 and the liner 251 through ports 112, however, this will be minimal as fluid in the annulus will substantially prevent this from occurring. Circulation, which will be explained hereafter, will remove any such cement that does pass into the annulus.

Figure 10A:
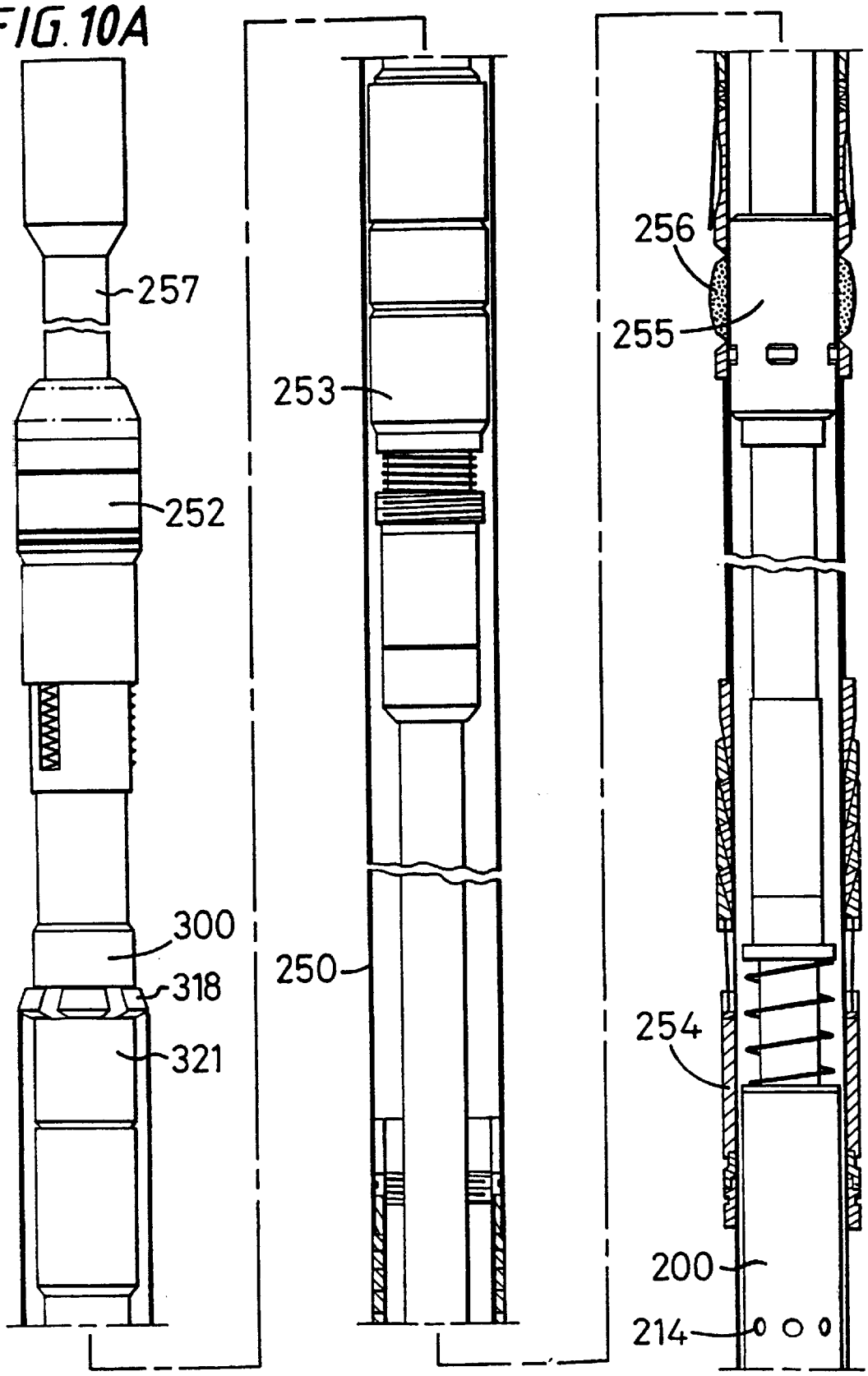
Figure 10B:
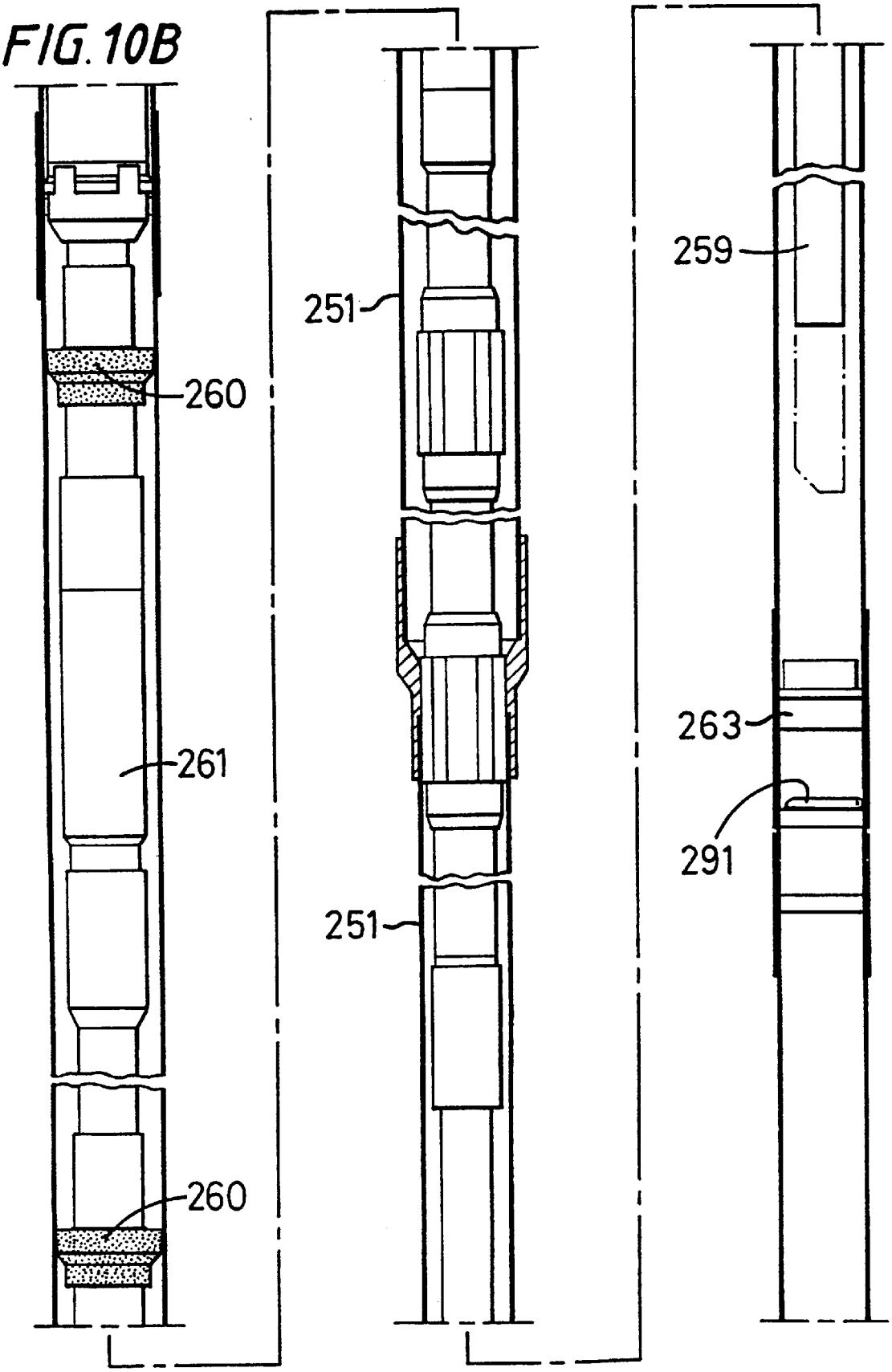
Figure 10C:
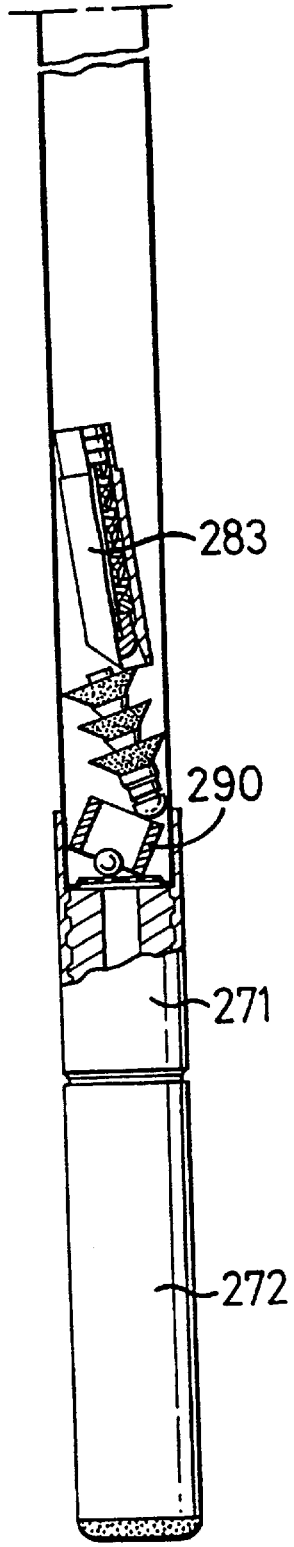

The junk bonnet 252 is then released from the polished bore receptacle 250. As the drill string is raised it lifts the packer actuator 300 until it is above the top 275 of the polished bore receptacle 250. The pack-off bushing 255 substantially prevents cement flowing into the liner 251 at this time as shown in FIGS. 10*a–c*.

Raising the drill string also removes the end of the stinger 259 from the stinger pack-off 263. The flap 291 closes and seals off the bottom of the liner 251 and the annulus between the liner 251 and the wellbore. Thus when circulation begins, the cement in the annulus between the liner 251 and the wellbore will substantially not be disturbed from the bottom of the liner 251.

Raising the drill string also lifts the setting tool 253 which allows the packer dogs 276 in packer 256 to move inwardly and out of longitudinal alignment with the polished bore receptacle 250 shown in FIG. 10. Dogs 318 now extend outwardly from the sleeve 307 of the packer actuator 300 and are retained by lip 321.

Drill string weight is applied. The weight is transferred to the polished bore receptacle 250, which moves the polished bore receptacle 250 down and activates the packer 256 which seals the annulus between polished bore receptacle 250 and the casing. This is carried out before the cement in the annulus between the polished bore receptacle 250 and the casing has had time to set.

Figure 11A:
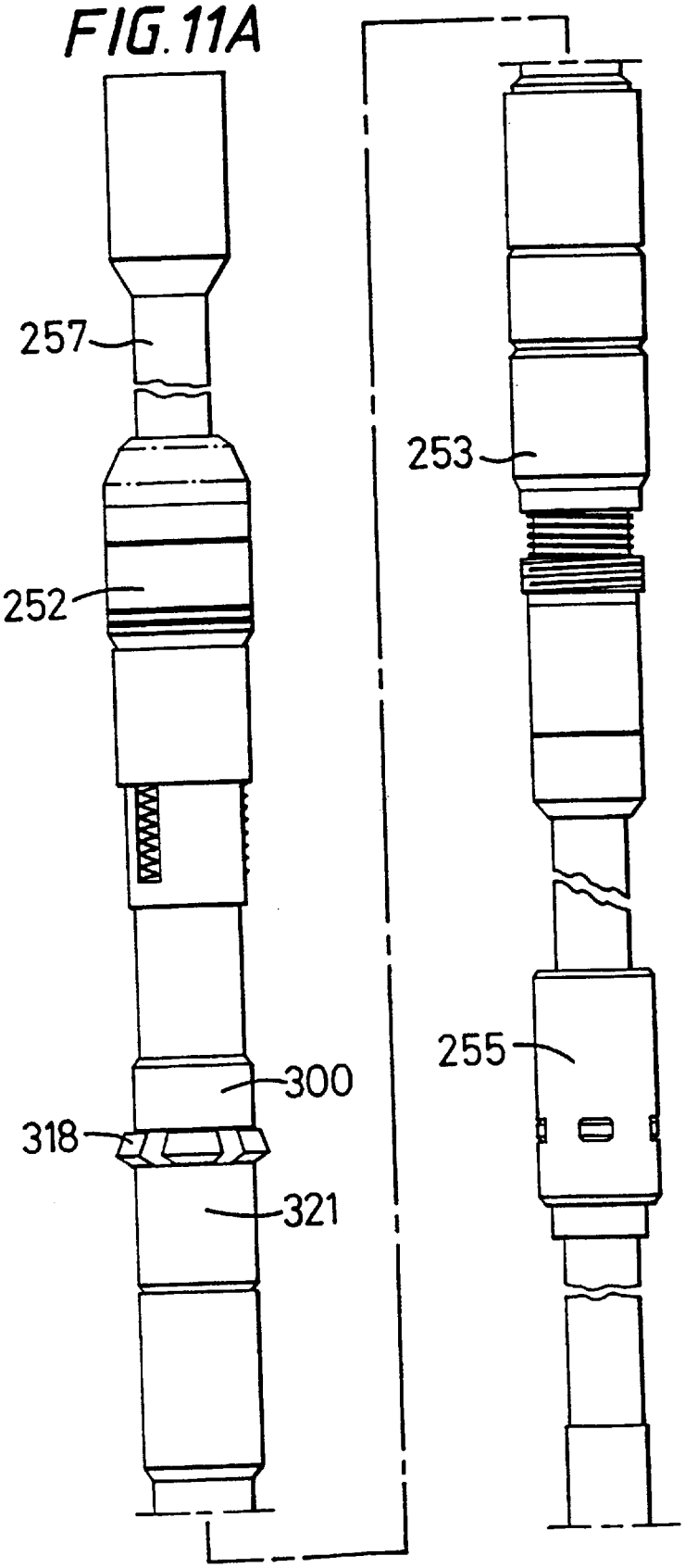
Figure 11B:
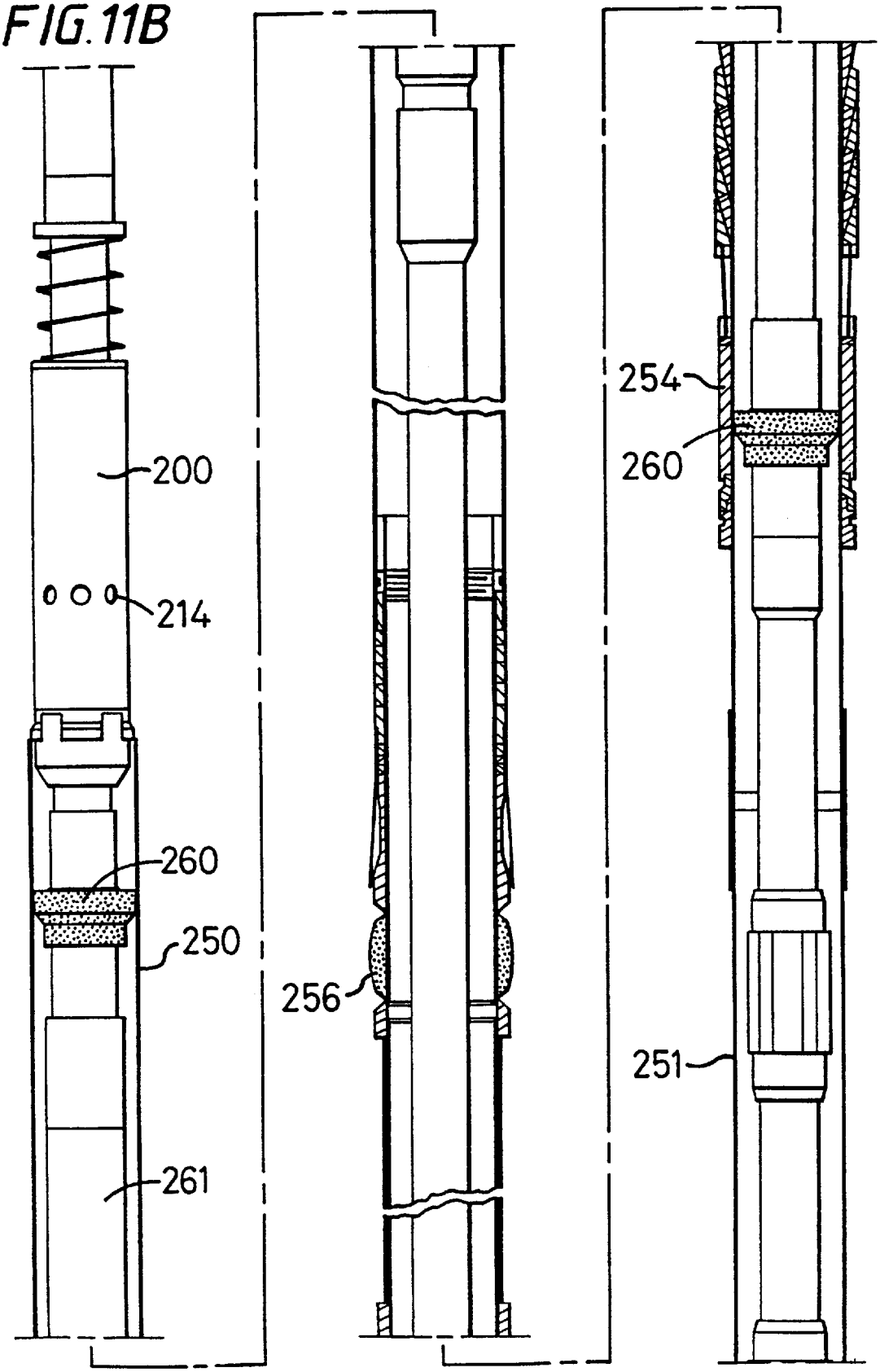
Figure 11C:
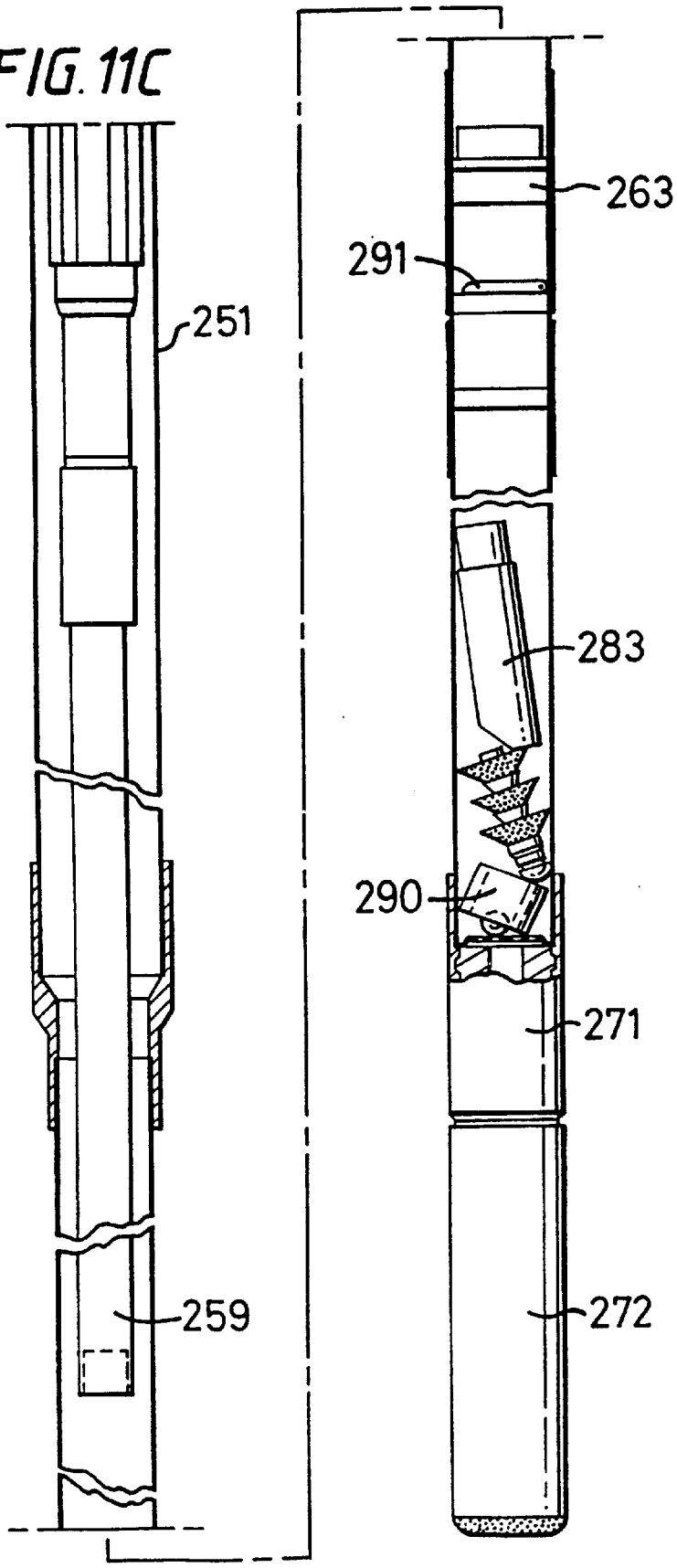
Figure 12A:
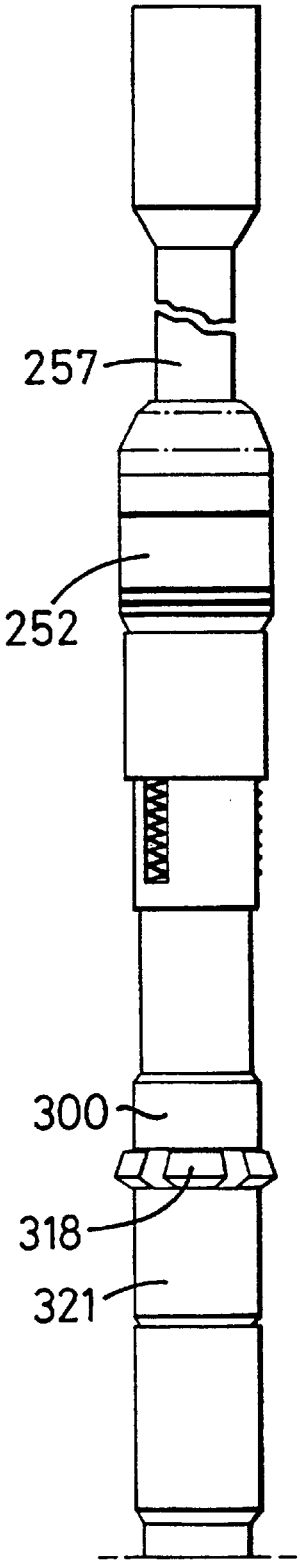
Figure 12B:
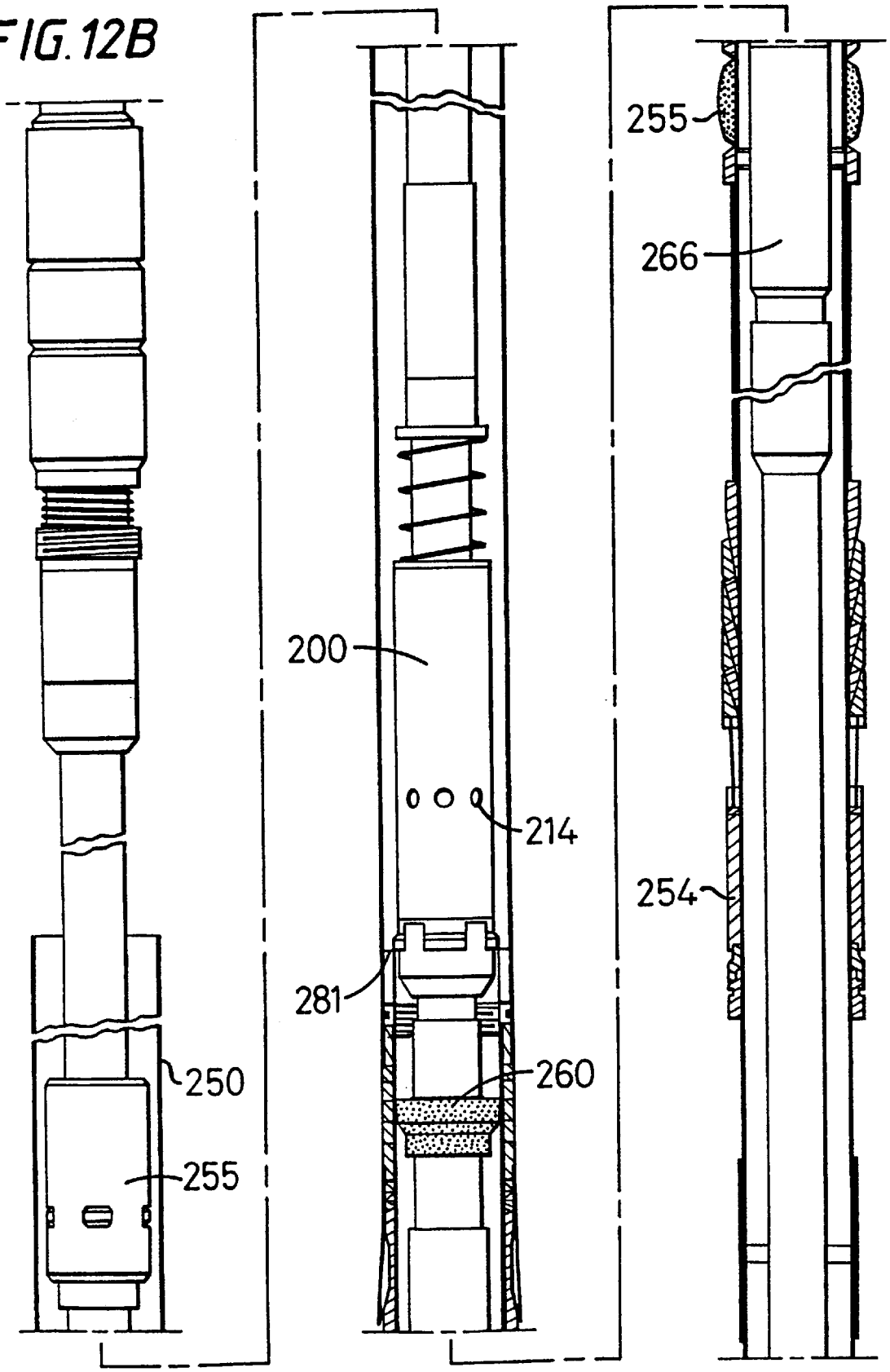
Figure 12C:
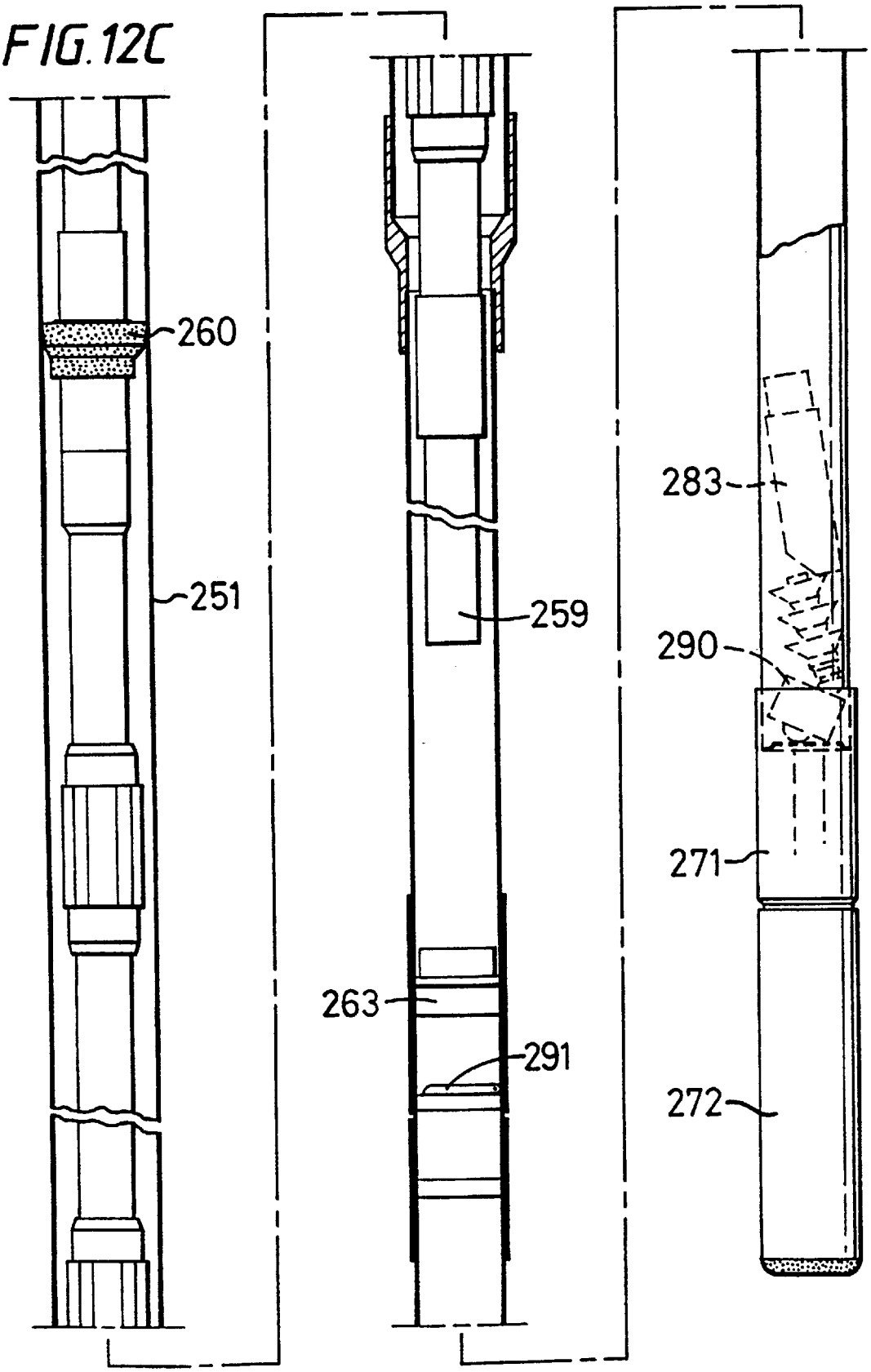

The drill string is then raised to remove pack-off bushing 255 from the packer 256. Circulation can now begin by pumping mud or sea water or any suitable circulation liquid down the drill pipe through the hollow mandrel 104 and through aligned ports 112 and sleeve ports 114. Note in this embodiment the aligned ports 112 are larger than in previous embodiments. The area of the aligned ports is at least equal and preferably greater than the cross sectional area of the stinger 259. Reverse circulation may be preferred, i.e. pumping mud down through the annulus made by the drill pipe and the casing through the aligned ports 112 and sleeve ports 114 and up through the hollow mandrel 104, as the annulus between the inner string and the casing or polished bore receptacle 250 allows greater fluid transfer from the surface to the bottom of the well as shown in FIG. 11*a–c*.

Cement wiper subs 260 are arranged beneath the pressure port straddle 200 and form a barrier in the annulus between the stinger 259 and the liner 251, and thereby substantially prevent any cement from falling into the majority of the length of the liner 251. The pressure port straddle 200 can be raised further up the liner 251 and into the polished bore receptacle 250. The dogs 118 now extend outwardly from the valve sleeve 107 of the pressure port straddle 200 and are retained from maximum extension by lip 121 of retaining ring 122. The pressure port straddle 200 can be raised up through and above polished bore receptacle 250 while circulation through ports 112, and sleeve ports 114 into the polished bore receptacle 250 and into the casing (not shown) while the cement wiper subs 260 remain in liner 251 and polished bore receptacle 250 as shown in FIG. 11.

The pressure port straddle 200 is then lowered and dogs 218 engage with shoulder 281 formed by the top of the liner 251. Drill string weight is then applied and released. The indexing pin 109 follows the channel 110 and locates in position 126 as shown in FIG. 6, the valve sleeve 107 moves upwardly against spring 105 and seals port 112.

Various modifications to the method are envisaged, such as in the method using the apparatus of the second embodiment (FIGS. 5 to 7*f*) the pressure port straddle 200 would remain inside liner 151 during the majority of circulation.

Both embodiments 100 and 200 would be suitable for use with non-cemented liners with the use of an inner string.

It should be noted that a barrier between the liner (51; 151) and the stinger (59; 159) is most advantageous while conducting circulation through either of the above embodiments above the liner.

An advantage of the second embodiment is that the pressure port straddle 200 is mounted below the liner hanger 154 and hence in an area which is not carrying the weight of the liner.

Referring now to FIG. 13 there is shown a casing scraper 500 which is arranged above the junk bonnet 52, 152 and 252. The casing scraper 500 comprises a tubular member 501 which forms part of the drill string (not shown). A scraper sleeve 502 is rotatably mounted, preferably on bearings 503, and longitudinally retained on tubular 501. Seals 504 are provided next to bearings 503. Scraper pads 505, 515 are mounted on springs 506 which are fixed to the scraper sleeve 502. The scrapers pads 505, 515 are arranged in two horizontal rows. Each row comprises three or four scraper pads 505, 515 arranged at 120° or 90° from each other about the central axis of the tubular 501. Three or four flow channels 507, 517 are disposed between the scraper pads 505, 515. The two horizontal rows are offset with respect to one another about the central axis of the tubular 501.

In use, the drill string, liner setting arrangement and casing scraper 500 are lowered into the casing. The scraper pads 505, 515 are biased against the interior surface of the casing by springs 506, 516 and hence scrape the interior surface of the casing as the casing scraper 500 is lowered into the casing. If the drill string needs to be rotated, the scrapers remain substantially fixed in relation to the casing, allowing the tubular 501 to rotate in relation to scraper sleeve 502.

What is claimed is:

1. A tool for use with a running tool for removing excess cement from the top of a liner after hanging and cementing thereof, the tool comprising a hollow mandrel, a valve sleeve, a spring acting on said valve sleeve and a first port in said hollow mandrel wherein said valve sleeve is movable to open and close said first port and wherein said valve sleeve is arranged substantially coaxially with said hollow mandrel wherein one of said valve sleeve and said hollow mandrel is provided with an indexing pin and the other of said hollow mandrel and said valve sleeve incorporates an irregular surface, and wherein said spring biases said indexing pin against said irregular surface.

2. A tool as claimed in claim 1 wherein said irregular surface forms one surface of an indexing channel.

3. A tool as claimed in claim 2 wherein said valve sleeve comprises sleeve ports and wherein said irregular surface comprises two lower points in which said port is closed and one upper point in which said first port is open.

4. A tool as claimed in claim 1 wherein said valve sleeve comprises at least one dog which is biased radially outwardly therefrom.

5. A tool as claimed in claim 1 wherein part of said tool forms a packer actuator.

6. A tool as claimed in claim 1 further comprising a stinger and a cement wiper sub for substantially preventing excess cement from falling into said liner.

7. A method for facilitating the removal of excess cement from the top of a liner after hanging and cementing thereof, comprising the steps of introducing circulating fluid in the vicinity of the top of said liner, and removing excess cement from the top of said liner with a tool, said tool comprising a hollow mandrel, a valve sleeve and a first port in said hollow mandrel wherein said valve sleeve is movable to open and close said first port and wherein said valve sleeve is arranged substantially coaxially with hollow mandrel wherein said tool is fitted to a running tool, said running tool having a stinger, and the method comprising circulating a fluid through the stinger of the running tool and through the liner.

8. A method according to claim 7 wherein said circulating fluid is introduced through a port in an upper string which extends to a position adjacent the bottom of the liner.

9. A method according to claim 7 wherein said step of circulating begins prior to setting of said excess cement.

10. A running tool configured removing excess cement from the top of a liner after hanging and cementing thereof, the running tool comprising:

a rotatable packer actuator comprising a hollow mandrel, a valve sleeve, a spring acting on said valve sleeve and a first port in said hollow mandrel wherein said valve sleeve is movable to open and close said first port and wherein said valve sleeve is arranged substantially coaxially with said hollow mandrel wherein one of said valve sleeve and said hollow mandrel is provided with an indexing pin and the other of said hollow mandrel and said valve sleeve incorporates an irregular surface, and wherein said spring biases said indexing pin against said irregular surface;

a stinger disposed beneath the rotatable packer actuator;

a cement wiper disposed between said rotatable packer actuator and said stinger; and a floating junk bonnet disposed above the rotatable packer actuator.

11. A running tool according to claim 10 further comprising a casing scraper disposed above the floating junk bonnet.

* * * * *